US009780497B1

(12) United States Patent
Jeon et al.

(10) Patent No.: US 9,780,497 B1
(45) Date of Patent: Oct. 3, 2017

(54) HIGH SPEED CONNECTOR ARRAY

(71) Applicant: Apple Inc., Cupertino, CA (US)

(72) Inventors: James M. Jeon, Mountain House, CA (US); Mahmoud R. Amini, Sunnyvale, CA (US); David H. Narajowski, Los Gatos, CA (US); Ruihua Ding, San Jose, CA (US); Christopher J. Stringer, Woodside, CA (US); Matthew P. Casebolt, Fremont, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/274,441

(22) Filed: Sep. 23, 2016

(51) Int. Cl.

| | |
|---|---|
| ***H01R 13/658*** | (2011.01) |
| ***H01R 13/659*** | (2011.01) |
| ***H01R 12/91*** | (2011.01) |
| ***H01R 13/631*** | (2006.01) |
| ***H01R 13/518*** | (2006.01) |
| ***H01R 13/646*** | (2011.01) |

(52) U.S. Cl.
CPC ..... *H01R 13/659* (2013.01); *H01R 12/91* (2013.01); *H01R 13/518* (2013.01); *H01R 13/6315* (2013.01); *H01R 13/646* (2013.01)

(58) Field of Classification Search
CPC .. H01R 13/659; H01R 13/658; H01R 13/646; H01R 13/6315; H01R 13/518; H01R 12/91
USPC .... 439/660, 607.54, 607.55, 607.25, 607.27, 439/76.1, 540.1, 541.5
See application file for complete search history.

(56) References Cited

U.S. PATENT DOCUMENTS

| | | | | |
|---|---|---|---|---|
| 8,968,031 | B2 * | 3/2015 | Simmel | H01R 13/659 439/108 |
| 2013/0330976 | A1 * | 12/2013 | Simmel | H01R 13/659 439/660 |
| 2014/0364008 | A1 * | 12/2014 | Simmel | H01R 13/64 439/607.23 |

FOREIGN PATENT DOCUMENTS

| | | | | |
|---|---|---|---|---|
| EP | 1337010 | * | 8/2003 | H01R 13/658 |

* cited by examiner

*Primary Examiner* — Harshad Patel
(74) *Attorney, Agent, or Firm* — Kilpatrick Townsend & Stockton LLP

(57) ABSTRACT

Combined connector receptacles, examples of which comprise tongues configured to be aligned to openings in a device enclosure; EMI shield contact rails, a central ground plane, a connector receptacle shield to provide isolation between the individual connector receptacles to reduce signal noise; and organizers and other structures arranged to reduce or eliminate damage to through-hole contact portions during their insertion into corresponding openings in a printed circuit board.

26 Claims, 26 Drawing Sheets

Section B-B'

HIGH SPEED CONNECTOR ARRAY

BACKGROUND

Power and data may be provided from one electronic device to another over cables that may include one or more wires, fiber optic cables, or other conductors. Connector inserts may be located at each end of these cables and may be inserted into connector receptacles in the communicating or power transferring devices.

These connector receptacles may be located in openings in enclosures of electronic devices. In some circumstances, it may be desirable to combine more than one connector receptacle into a single unit, which may be referred to as a combined connector receptacle.

Various problems may arise when connector receptacles are gathered into a combined connector receptacle. For example, it may be difficult to align multiple connector receptacles to openings in an enclosure of an electronic device. This may be particularly true when the surface of the enclosure is nonplanar.

Also, contacts in each connector receptacle may convey high-speed signals, power supplies, and other signals. The high-speed signals may have relatively fast edges. These fast edges may have high-frequency signal components that may degrade nearby power supplies. The high-frequency signal components from the high-speed signals and nearby power supplies may couple onto high-speed signal contacts in the same or other connector receptacle in the combined connector receptacle, thereby degrading the performance of the same or other connector receptacle.

Contacts in a connector receptacle may terminate in through-hole contact portions that may be inserted into corresponding openings in a board during device assembly. Including more than one connector receptacle in a combined connector receptacle may make the insertion of the through-hole contact portions more complicated. Specifically, the number of contacts and corresponding through-hole contact portions may increase, thereby making alignment of the through-hole contact portions to corresponding openings in a board more difficult.

Thus, what is needed are combined connector receptacles that may be aligned to openings in a device enclosure, may provide isolation between individual connector receptacles, may have reduced noise coupling to high-speed signal contacts within a connector receptacle, and may have structures arranged to reduce or eliminate damage to through-hole contact portions during their insertion into corresponding openings in a printed circuit board.

SUMMARY

Accordingly, embodiments of the present invention may provide combined connector receptacles that may be aligned to openings in a device enclosure, may provide isolation between individual connector receptacles, may have reduced noise coupling to high-speed signal contacts within a connector receptacle, and may have structures arranged to reduce or eliminate damage to through-hole contact portions during their insertion into corresponding openings in a printed circuit board.

An illustrative embodiment of the present invention may provide a combined connector receptacle having a housing with a number of slots. Each slot may be shielded with an electromagnetic interference (EMI) contact rail. Individual connector receptacles may be inserted into each slot. The individual connector receptacles may physically float relative to the housing of the combined connector receptacle. This floating may provide enough leeway or tolerance such that each connector receptacle may be aligned with an opening in a device enclosure. This floating may also provide protection for the connector receptacle during insertion of a connector insert. An alignment pin that may be inserted in an opening or recess of a device enclosure may also be included as part of the combined connector receptacle.

These and other embodiments of the present invention may provide a combined connector receptacle that may be used to provide multiple connector receptacles where a surface of the device enclosure is nonplanar. For example, a top of a housing for the combined connector receptacle may have openings that are oblique to other openings in the combined connector housing. Connector receptacle portions, such as connector receptacle tongues, may emerge from the openings at oblique angles as well.

These and other embodiments of the present invention may provide a combined connector receptacle having improved EMI isolation between individual connector receptacles. For example, a combined connector receptacle may include a housing having a number of slots. Each slot may be shielded using an EMI contact rail. Individual connector receptacles may be inserted into each slot. Each connector receptacle may be individually shielded. Also, each tongue of a connector receptacle may include a central ground plane to isolate contacts on a top side of a tongue from contacts on a bottom side of the tongue. The housing of the combined connector receptacle may be further shielded. The shields around the connector receptacles, the central ground plane, and the shields around the housing of the combined connector receptacle may include tabs or through-hole contact portions that may be fit in openings in a printed circuit board or other appropriate substrate where they may be connected to ground planes or traces. These several layers of shielding may provide a combined connector receptacle having improved EMI isolation between individual connector receptacles. The combined connector receptacle may be mounted on the printed circuit board or other appropriate substrate such that the tongues of the individual connector receptacles are substantially orthogonal to the printed circuit board, though they may be at least somewhat oblique to the printed circuit board due to the nonplanar nature surface of the device enclosure. In these and other embodiments of the present invention, the tongues may be located in openings in a device enclosure or portion of a device enclosure to form a complete connector receptacle with a tongue and recess. The device enclosure or portion of a device enclosure may be metallic, plastic, or other material. Openings in the device enclosure or portion of a device enclosure may include spring fingers to be electrically connected to shields of the connector receptacles. This may further improve EMI isolation between individual connector receptacles and between the combined connector receptacle and other circuits or components.

These and other embodiments of the present invention may provide a combined connector receptacle having improved EMI isolation within individual connector receptacles. For example, each tongue of a connector receptacle may include a central ground plane to isolate contacts on a top side of a tongue from contacts on a bottom side of the tongue. Contacts for each high-speed differential pair on a top or bottom side of the tongue may be adjacent on each lateral side to a power supply or ground contact such that a power supply or ground contact may be between nearby high-speed differential pair signal contacts. These power supply or ground contacts between high-speed differential pair signal contacts may isolate the high-speed differential pair signal contacts.

To further improve this isolation, these power supply or ground contacts may each be coupled to the central ground plane by decoupling capacitors. In these and other embodiments of the present invention, the decoupling capacitors may be formed using a high-dielectric constant structure. Specifically, a high-dielectric constant structure may be placed between a power supply or ground contact and the central ground plane to form a decoupling capacitor. In these and other embodiments of the present invention, other types of decoupling capacitors may be used. For example, discrete capacitors, such as ceramic, film, electrolytic, or other types of capacitors, may be used. Biasing members may be included to ensure a good electrical connection between the discrete capacitors and the power and ground contacts and central ground plane. The biasing members may be springs, they may be formed of a conductive and compressible material, or they may be other types of biasing members. These decoupling capacitors may be located in a housing of a combined connector receptacle, in a housing of an individual connector receptacle, in a tongue of a connector receptacle, or elsewhere in a combined connector receptacle.

These and other embodiments of the present invention may provide a combined connector receptacle having a housing with a number of slots. Each slot may be shielded with an EMI contact rail. Individual connector receptacle may be inserted into each slot. The individual connector receptacles may physically float relative to the housing of the combined connector receptacle. This floating may allow through-hole contact portions for the connector receptacles to be aligned to each other. An organizer may be fit over the through-hole contact portions for the various connector receptacles. The through-hole contact portions of the combined connector receptacle may then be inserted into a printed circuit board, such as a printed circuit board or other appropriate substrate.

In these and other embodiments of the present invention, the organizer may be fit against one or more connector receptacles in a combined connector receptacle unit. The through-hole contact portions of the combined connector receptacle unit may then be inserted into corresponding holes in a printed circuit board or other appropriate substrate. In other embodiments of the present invention, the organizer may be positioned away from the combined connector receptacle towards ends of the through-hole contact portions. During assembly, a combined connector receptacle unit may be placed on the printed circuit board such that an organizer contacts or is near the printed circuit board. The combined connector receptacle unit may be pushed onto the printed circuit board such that the organizer is moved towards the combined connector receptacle and the through-hole contact portions are pushed into corresponding openings in a printed circuit board or other appropriate substrate.

While an organizer may be used to align through-hole contact portions to corresponding openings in a printed circuit board, openings in a device enclosure or device enclosure portion may be used to align the tongues of the connector receptacles of a combined connector receptacle. The openings in an inside surface of the device enclosure or device enclosure portion may have tapered lead-ins to guide the individual connector receptacle tongues during mating of the combined connector receptacle to the openings in a device enclosure or device enclosure portion. The device enclosure or device enclosure portion may be at least partially held in place with pieces of foam or other compliant piece. This may allow the device enclosure or device enclosure portion to slightly reposition itself so that it may be easier to mate with the combined connector receptacle. Since the individual connector receptacles may physically float in the housing of the combined connector receptacle, the openings in the device enclosure or device enclosure portion may determine a final position of the tongues of the connector receptacles.

While embodiments of the present invention may be useful in combined connector receptacles, these and other embodiments of the present invention may be used in single connector receptacle structures as well.

In various embodiments of the present invention, contacts, central ground planes, shields, EMI contact rails, and other conductive portions of a combined connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings, tongues, organizers, and other portions may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The biasing members and high-dielectric constant structures may be formed of various materials. The printed circuit boards used may be formed of FR-4 or other material. Printed circuit boards may be replaced by other substrates, such as flexible circuit boards, in many embodiments of the present invention.

Embodiments of the present invention may provide combined connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These combined connector receptacles may provide pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these connector inserts and connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
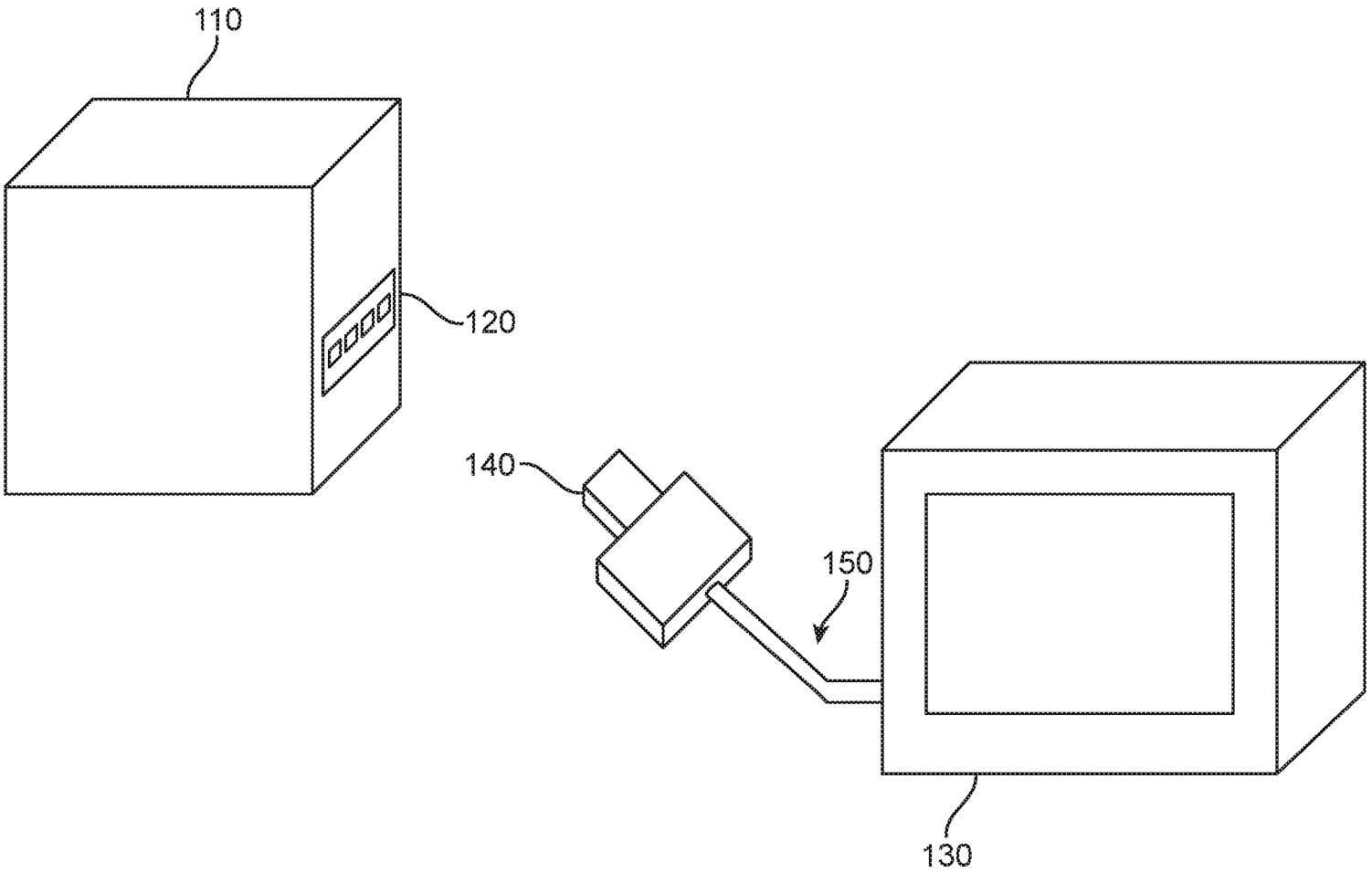
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

This electronic system includes computer 110 and electronic device 130. Computer 110 may communicate with electronic device 130 through cable 150. Specifically, connector insert 140 may be inserted into one of the group of connector receptacles in combined connector receptacle 120 on computer 110, and computer 110 may communicate with an electronic device 130 by sending and receiving signals and power, through conductors in cable 150.

Again, it may be desirable for computer 110 to communicate with several devices. These devices may be able to communicate with computer 110 using the same interface standard. Accordingly, several connector receptacles of the same type may be provided as a combined connector receptacle 120, though in other embodiments of the present invention, two or more connector receptacles in combined connector receptacle 120 may be different from each other. Combined connector receptacle 120 may include a number of individual connector receptacles, each having a number of contacts or pins, which may terminate in through-hole contact portions that are soldered in openings connected to traces in a printed circuit board (not shown) in computer 110.

Unfortunately, when several connector receptacles are provided as a unit, it may be very difficult to align through-hole contact portions for the contacts of the connector receptacles to openings in a printed circuit board. It may also be difficult to align the connector receptacle tongues to corresponding openings in a device enclosure of computer 110. This is particularly true if a surface of the device enclosure for computer 110 is curved at these openings.

Accordingly, an illustrative embodiment of the present invention may provide a combined connector receptacle having a housing with a number of slots. Each slot may be shielded with an EMI contact rail. Individual connector receptacle may be inserted into each slot. The individual connector receptacles may physically float relative to the housing of the combined connector receptacle. This floating may provide enough leeway or tolerance that each connector receptacle may be aligned with an opening in a device enclosure. This floating may also provide protection for the connector during insertion of a connector insert. An alignment pin to fit in an opening or recess of a device enclosure may also be included as part of the combined connector insert. This alignment pin may be conductive or nonconductive. An example of such a combined connector receptacle is shown in the following figures.

Figure 2:
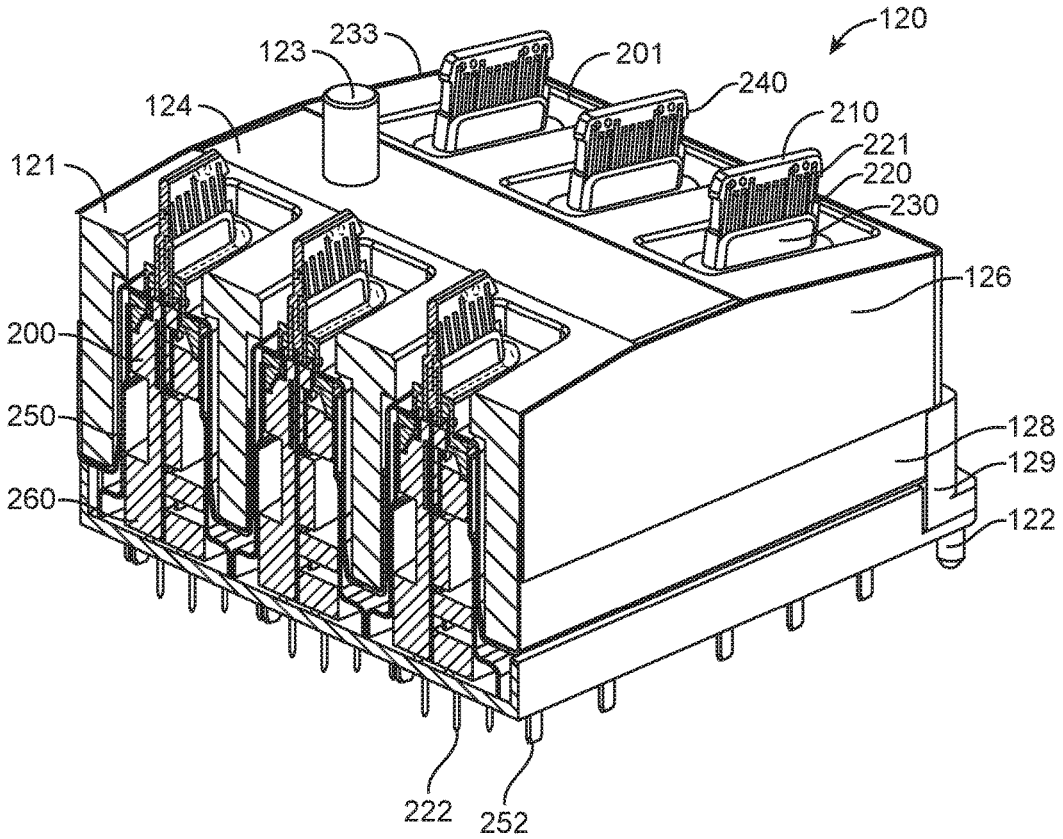
FIG. 2 illustrates a combined connector receptacle according to an embodiment of the present invention.

FIG. 2 illustrates combined connector receptacle 120 according to an embodiment of the present invention. Combined connector receptacle 120 may include a number of connector receptacles 200 located in slots 201 in housing 121. Combined connector receptacle 120 may be shielded by strap 124, shield 126, and EMI contact rail 128. Combined connector receptacle 120 may further include an alignment pin 123. Alignment pin 123 may be inserted into opening or recess in device enclosure 2210 (shown in FIG. 22) of a device that includes combined connector receptacle 120. Housing 121 may include post structures 129 that may terminate in posts 122. Posts 122 may be inserted in openings in a printed circuit board, flexible circuit board, or other appropriate substrate 510 (shown in FIG. 22).

Tongues 210 for connector receptacles 200 may emerge from slots 201. Tongues 210 may support a number of contacting portions 221 of contacts 220 on its top and bottom sides. Tongues 210 may further support ground contacts 230 on the top and bottom side. Contacting portions 221 of contacts 220 may mate with corresponding contacts of connector insert 2230 (shown in FIG. 22) when connector insert 2230 is inserted into connector receptacle 200. Ground contacts 230 may mate with corresponding ground contacts in connector insert 2230 when connector insert 2230 is inserted into connector receptacle 200. Tongue 210 may further include notches 240 on its sides. These notches 240 may provide a retention force along with ground contacts (not shown) of connector insert 2230 that may engage notches 240 when connector insert 2230 is inserted into connect receptacle 200. Side ground contact 233 may be located in notches 240 and may electrically connect to the side ground contacts of connector insert 2230. Each connector receptacle 200 may include housing 260, which may be at least partially surrounded by shield 250. Contacts 220 may terminate in through-hole contact portions 222, which may emerge from bottoms of housings 260. Shields 250 for connector receptacles 200 may terminate in tabs 252. Through-hole contact portions 222 and tabs 252 may be inserted into openings in a printed circuit board, flexible circuit board, or other appropriate substrate 510 (shown in FIG. 22). Combined connector receptacle 120 may be mounted on printed circuit board 510. Tongues 210 of individual connector receptacles 200 may be substantially orthogonal to printed circuit board 510, with a possible variance due to a curvature of at top of housing 121. The curvature of the top of housing 121 may be arranged to fit with an inside surface of device enclosure 2210 (shown in FIG. 22).

Figure 3:
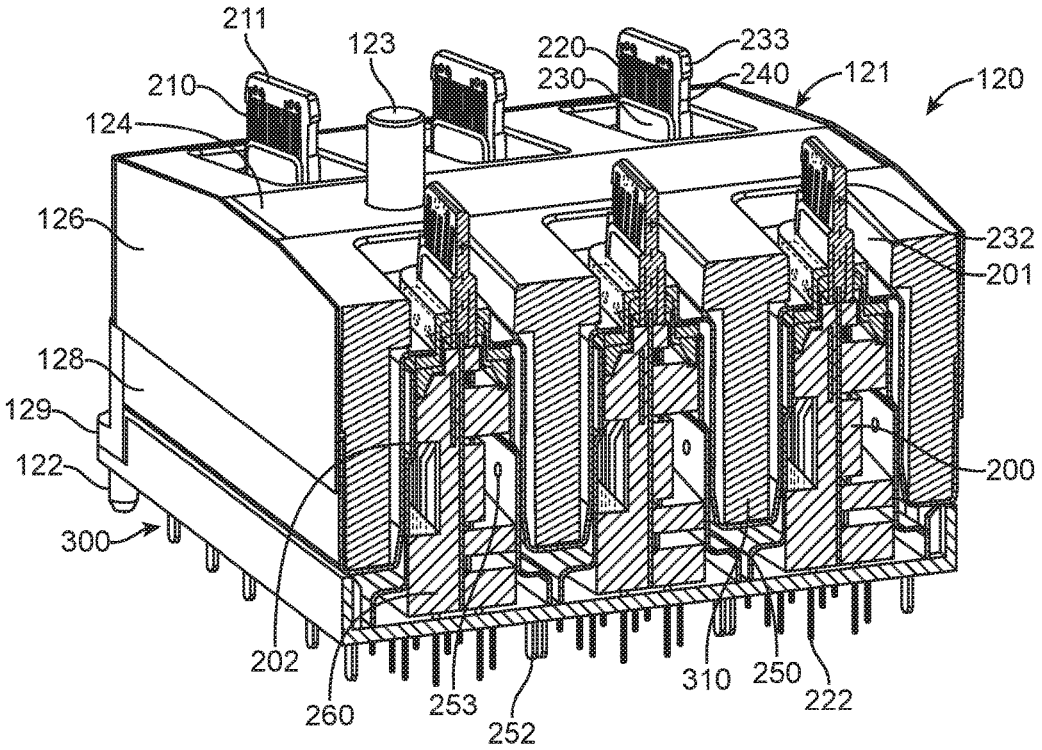
FIG. 3 illustrates a cutaway side view of a combined connector receptacle according to an embodiment of the present invention.

FIG. 3 illustrates a cutaway side view of combined connector receptacle 120 according to an embodiment of the present invention. Again, housing 121 of combined connector receptacle 120 may include a number of slots 201. Housing 121 may be shielded by strap 124, shield 126, and EMI contact rail 128. Specifically, strap 124 may be located along a front center of combined connector receptacles 120. The top sides of housing 121 may be shielded by shield 126. The bottom sides of housing 121 may be shielded by EMI contact rail 128. EMI contact rail 128 may fold underneath the bottom of housing 121 and extend along inside wall 202. EMI contact rail 128 may make physical contact and an electrical connection with shield 250 around connector receptacle 200 for outer connector receptacles 200. Shields 250 for middle connector receptacles 200 may be electrically connected to shields 250 for outer connector receptacles 200 via intermediate EMI contact rails 310. Intermediate EMI contact rails 310 may electrically connect shields 250 for adjacent connector receptacles 200 to each other. In this way, strap 124 may be electrically connected to and in physical contact with shield 126, which may be electrically connected to and in physical contact with EMI contact rail 128, which may be electrically connected to and in physical contact with shields 250 of connector receptacles 200, either directly or via intermediate EMI contact rails 310.

Tongues 210 for connector receptacles 200 may emerge from slots 201. Tongues 210 may support a number of contacting portions 221 (shown in FIG. 2) of contacts 220 and ground contacts 230. Sides of tongues 210 may include notches 240. Side ground contacts 233 may be located in notches 240. Side ground contacts 233 may be formed by edges of central ground plane 232. Contacting portions 221 of contacts 220 may be located between ground contacts 230 and a front or leading edge 211 of tongue 210 on both a top and bottom side of tongue 210.

Connector receptacles 200 may be held in place at least partially by dimples 262 (shown in FIG. 8) on housing 260, which may be located in openings 253 in shield 250 and corresponding openings (not shown) in either EMI contact rail 128 or intermediate EMI contact rail 310. Alignment pin 123 may be inserted into a recess or opening in housing 121

Figure 22:
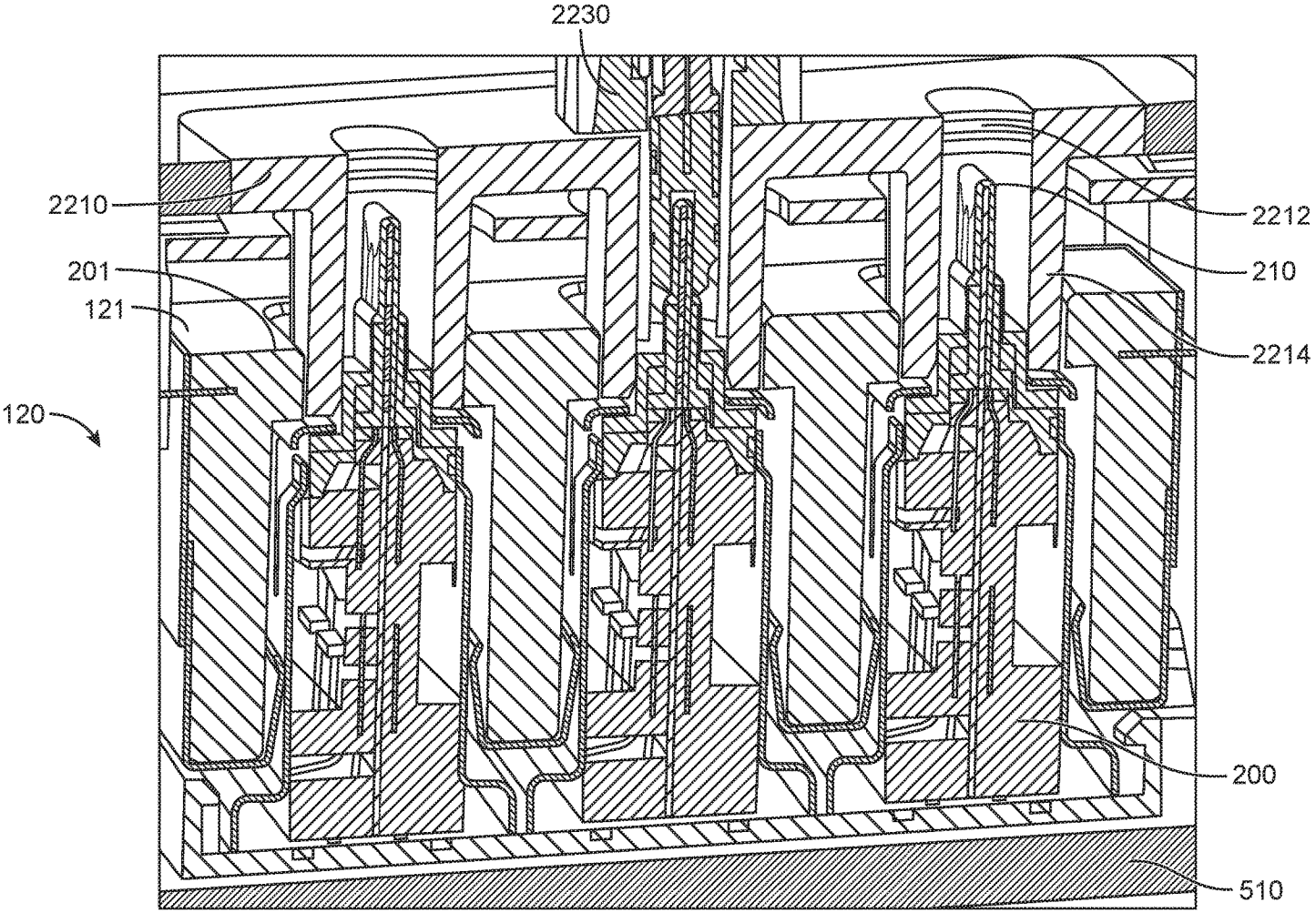
FIGS. 22-23 are side views of a combined connector receptacle in an electronic device according to an embodiment of the present invention.

Again, embodiments of the present invention are well-suited for use in devices where a device enclosure, such as device enclosure 2210 in FIG. 22, includes a curved surface. Accordingly, at least two of connector receptacles 200 may have tongues 210 that are at an oblique angle to each other in at least one plane. In other embodiments of the present invention, connector receptacles 200 may have tongues 210 that are parallel to each other, or their tongues 210 may be oblique or orthogonal to each other in one or more different planes.

While embodiments of the present invention may be useful in combined connector receptacles 120, these and other embodiments of the present invention may be used in single connector receptacle structures. Also, while six connector receptacles 200 are shown in these examples, in these and other embodiments of the present invention, other numbers of connector receptacles 200 may be included.

The connector receptacle contacts 220 may have contact portions 221 on tongues 210 and may emerge from a bottom of housing 260 as through-hole contact portions 222, though in other embodiments of the present invention, they may emerge as surface-mount contact portions. Shields 250 for connector receptacles 200 may terminate in tabs 252. Through-hole contact portions 222 and tabs 252 may be inserted into openings in printed circuit board 510 (shown in FIG. 22). Housing 121 may be attached to post structures 129 that may terminate in posts 122. Posts 122 may also be inserted in openings in printed circuit board 510.

It may be difficult to align these through-hole contact portions 222, tabs 252, and posts 122 in their corresponding holes in printed circuit board 510 in FIG. 22. This may lead to one or more of the through-hole contact portions 222 or tabs 252 being "crushed" and otherwise destroyed or damaged when combined connector receptacle 120 is mated to printed circuit board 510.

Accordingly, embodiments of the present invention may employ an organizer 300. Organizer 300 may include openings for some or all of the through-hole contact portions 222, tabs 252, and posts 122. Organizer 300 may keep these structures aligned when combined connector receptacle 120 is mated with a printed circuit board, such as printed circuit board 510 in FIG. 22. An example of such an organizer is shown in the following figure.

Figure 4:
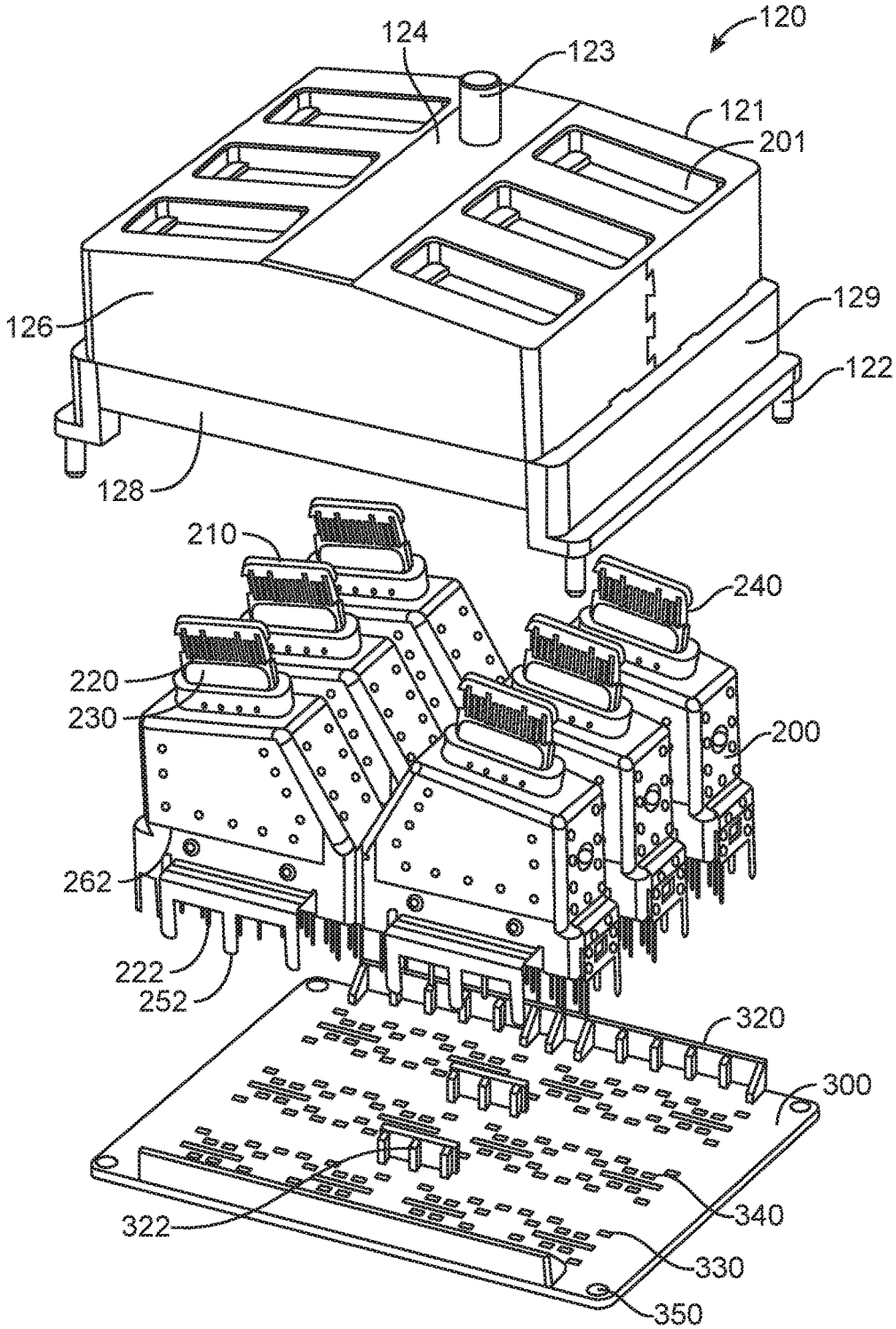
FIG. 4 is an exploded view of a combined connector receptacle according to an embodiment of the present invention.

FIG. 4 illustrates an exploded view of combined connector receptacle 120 according to an embodiment of the present invention. Combined connector receptacle 120 may include housing 121, a plurality of connector receptacles 200, and organizer 300. Housing 121 may include a plurality of slots 201. EMI contact rails 128 and intermediate EMI contact rails 310 (shown in FIG. 3) may be inserted along sides of housing 121 and in slots 201. Strap 124 may be placed along a center of top surface of housing 121. Alignment pin 123 may be inserted into a recess or opening in housing 121. Shield 126 may be placed around the top sides of housing 121 such that it is in physical and electrical contact with strap 124 and EMI contact rails 128. Post structures 129 including posts 122 may be attached to housing 121.

Connector receptacles 200 may be inserted into slots 201 in housing 121. Connector receptacles 200 may be inserted between EMI contact rails 128 and intermediate EMI contact rails 310 in slots 201 until dimple 262 is aligned with openings (not shown) in EMI contact rails 128 and intermediate EMI contact rails 310. Tongues 210 may support contacts 220 and ground contacts 230. Tongues 210 may include notches 240 in their sides. Contacts 220 may terminate in through-hole contact portions 222. Shields 250 (shown in FIG. 3) around connector receptacles 200 may terminate in tabs 252.

Organizer 300 may include raised portions 320 and 322. Raised portions 320 and 322 may help secure organizer 300 in place along a bottom of combined connector receptacle 120. Tabs 252 may fit into openings 340, while through-hole contact portions 222 may fit in openings 330 of organizer 300. Posts 122 may be inserted through openings 350 in organizer 300. Organizer 300 may prevent "pin crush" from occurring with through-hole contact portions 222 or tabs 252 as the combined connector receptacle 120 is inserted into printed circuit board 510 (shown in FIG. 22). A method of such an insertion is shown in the following figures.

In various embodiments of the present invention, organizer 300 may be installed flush to a bottom surface of a combined connector receptacle 120. In other embodiments of the present invention, organizer 300 may be installed a distance away from the bottom surface of the combined connector receptacle 120. In this embodiment, as the combined connector receptacle 120 is installed, printed circuit board 510 may push the organizer such that it is, or is nearly flush with the bottom side of the combined connector receptacle 120 after insertion. An example is shown in the following figure.

Figure 5:
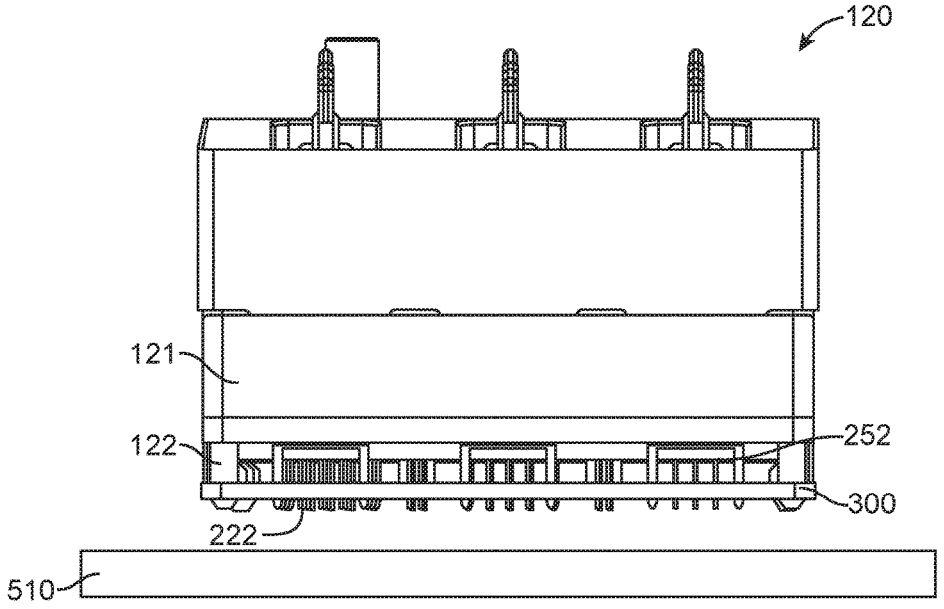
FIGS. 5-7 illustrate an installation of a combined connector receptacle and organizer according to an embodiment of the present invention.
Figure 6:
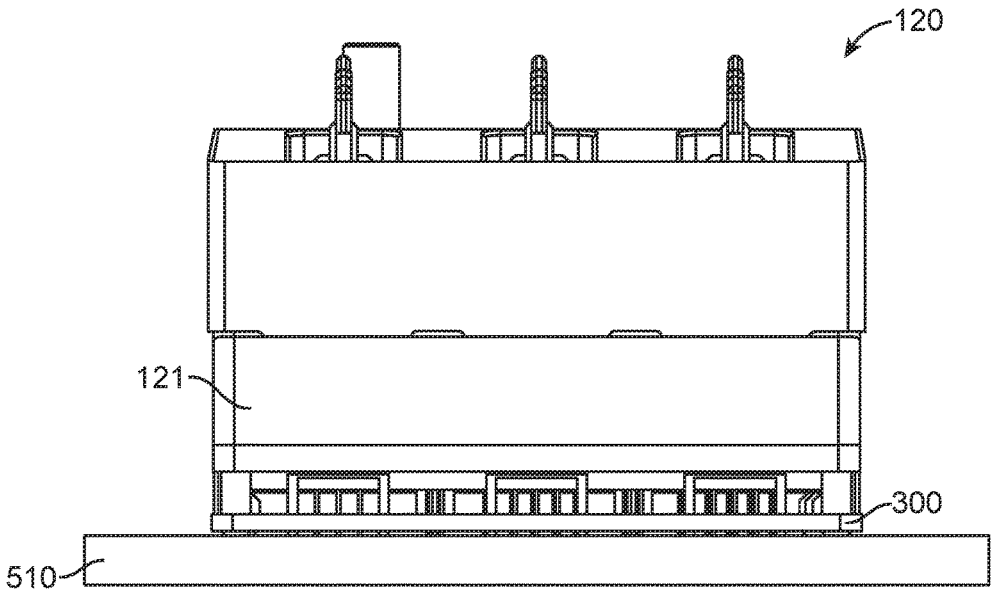
Figure 7:
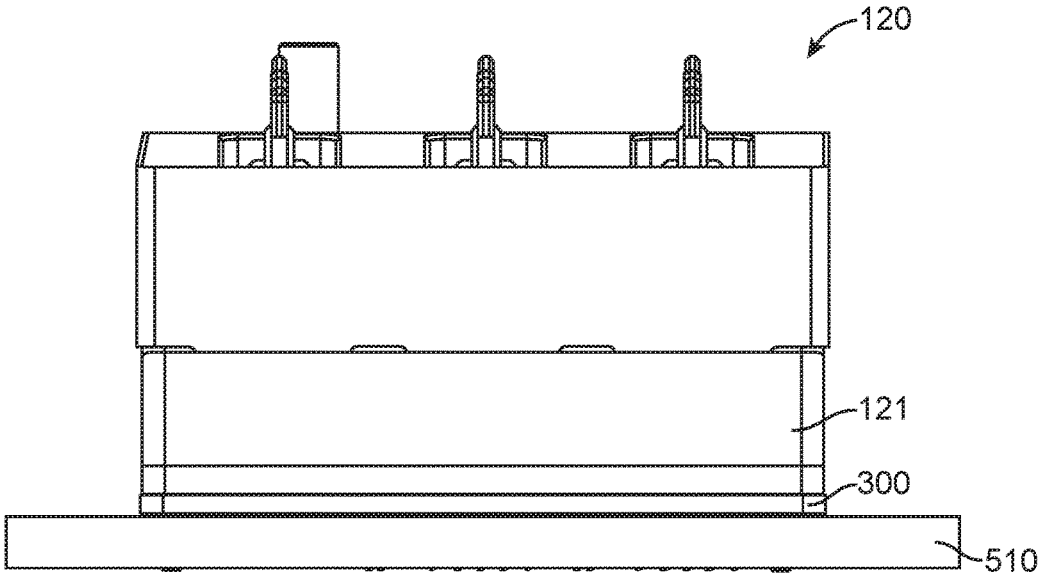

FIGS. 5-7 illustrate an installation of combined connector receptacle 120 including organizer 300 according to an embodiment of the present invention. FIG. 5 shows an initial state where organizer 300 may be installed a distance away from a bottom side of housing 121 of combined connector receptacle 120. Through-hole contact portions 222, tabs 252, and posts 122 may be aligned with openings (not shown) in printed circuit board 510, where printed circuit board 510 may be a flexible circuit board or other appropriate substrate. In FIG. 6, the combined connector receptacle 120 is shown in the process of being inserted into printed circuit board 510. In this position, organizer 300 may be offset from a bottom of housing 121. FIG. 7 shows a final state, where the combined connector receptacle 120 may be inserted into printed circuit board 510. In this final state, organizer 300 may be flush with a bottom of combined connector receptacle 120 and a top surface of printed circuit board 510. In other embodiments of the present invention, organizer 300 may be flush, or nearly flush, with an underside of the combined connector receptacle 120 before the combined connector receptacle 120 is mated with printed circuit board 510. In these and other embodiments of the present invention, organizer 300 may be formed of various materials. For example, organizer may be nonconductive and may be formed of plastic, fibers, fiberglass, or other material.

Figure 8:
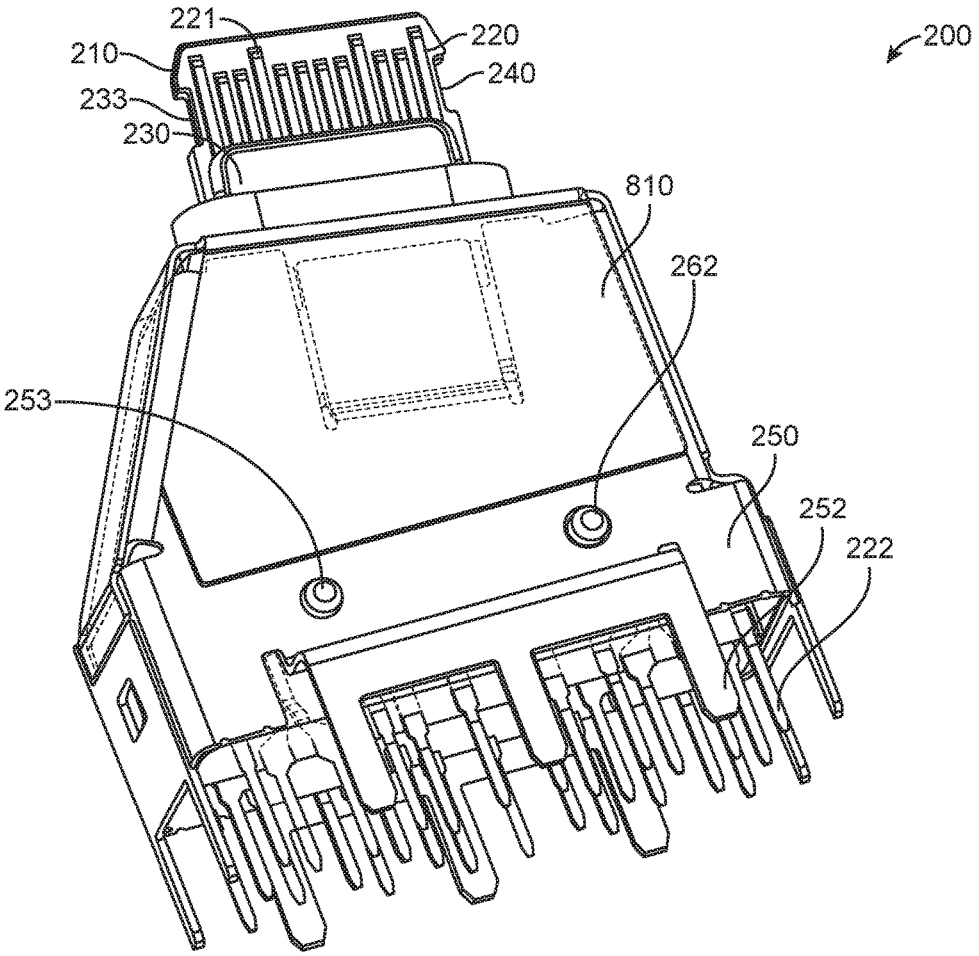
FIG. 8 illustrates a connector receptacle according to an embodiment of the present invention.

FIG. 8 illustrates connector receptacle 200 according to an embodiment of the present invention. Connector receptacle 200 may include tongue 210. Tongue 210 may support a number of contacts 220 and ground contacts 230 on a top and a bottom side. Tongue 210 may further include notches 240. Side ground contacts 233 may be located in notches 240. Connector receptacle 200 may be covered by shield 250. Shield 250 may include openings 253 for dimples 262. Shield 250 may terminate in tabs 252. Contacts 220 may include contacting portions 221 and may terminate in through-hole contact portions 222. Shield 250 may be partially covered by over-shield portion 810.

While connector receptacle 200 shown herein may be useful in combined connector receptacles 120, these and other embodiments of the present invention may be used in single connector receptacle structures where only one connector receptacle 200 is included. Also, while six connector receptacles 200 are shown in the above examples, in these and other embodiments of the present invention, other numbers of connector receptacles 200 may be included.

Signals conveyed by contacts 220 in connector receptacle 200 may be shielded by adjacent contacts and a central ground plane. This may help to prevent signal components of a signal conveyed in a connector receptacle 200 from corrupting a second signal in the same or different connector receptacle 200. An example is shown in the following figure.

Figure 9:
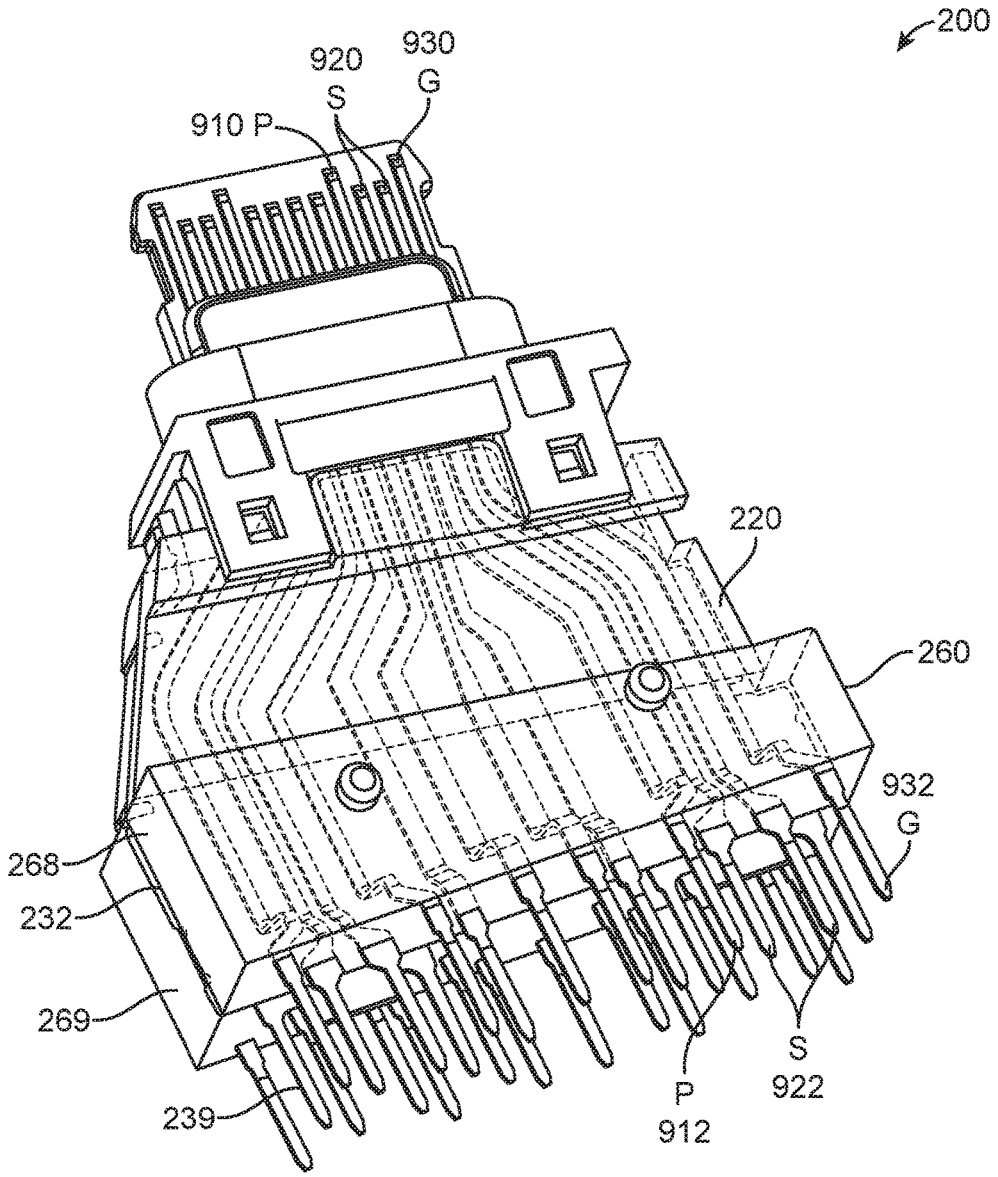
FIG. 9 illustrates a transparent view of a connector receptacle according to an embodiment of the present invention.

FIG. 9 illustrates a transparent view of connector receptacle 200 according to an embodiment of the present invention. Connector receptacle 200 may include contacts 920 for conveying a differential signal pair. These differential signal contacts 920 may be adjacent to power supply contact 910 and ground contact 930. These various contacts may pass through housing 260. The differential signal contacts 920 may terminate in through-hole contact portions 922, the power supply contact 910 may terminate in through-hole contact portion 912, and ground contact 930 may terminate in through-hole contact portion 932.

A central ground plane 232 may extend through the middle of housing 260. Housing 260 may be formed of a top housing portion 268 and a bottom housing portion 269. Central ground plane 232 may terminate in through-hole contact portions 239. In this way, through-hole contact portions 922 for signal contacts 920 may be surrounded by through-hole contact portion 912 for power, through-hole contact portion 932 for ground, and through-hole contact portions 239 for the central ground plane 232. This may provide EMI isolation for the differential signal conveyed on contacts 920, thereby reducing coupling to those contacts and preventing the signals on those contacts from coupling elsewhere in a combined connector receptacle and an electronic device that houses the combined connector receptacle.

Figure 10:
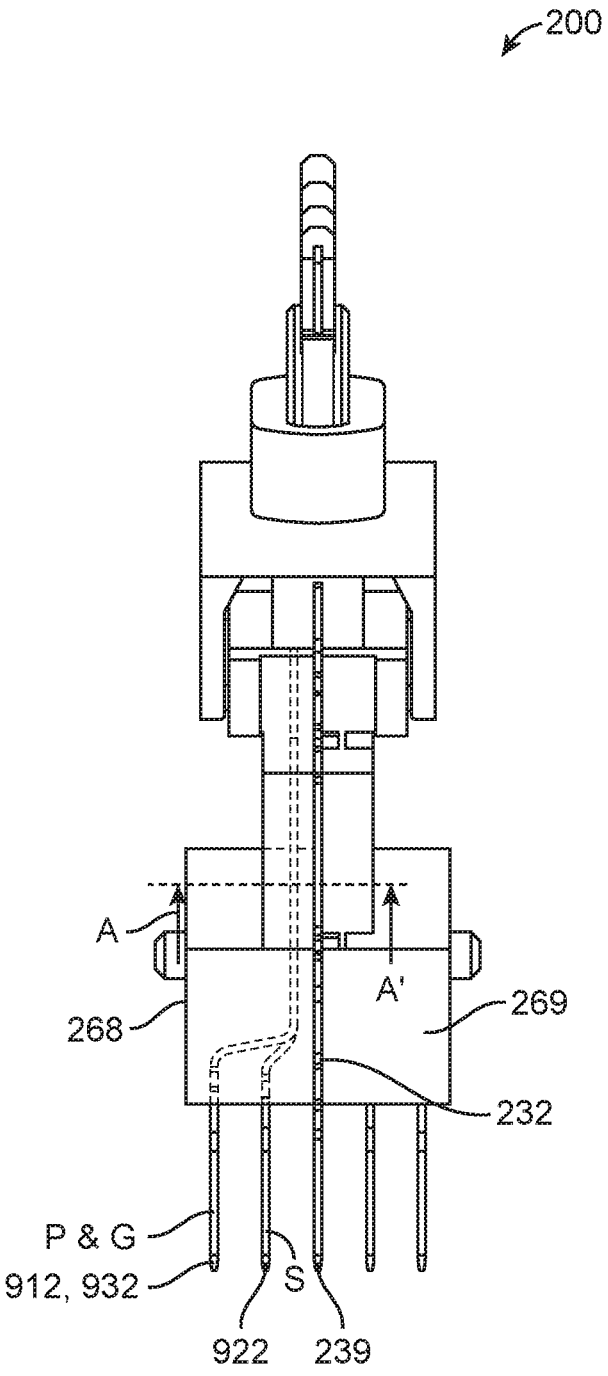
FIG. 10 illustrates a side view of a connector receptacle according to an embodiment of the present invention.

FIG. 10 illustrates a side view of connector receptacle 200 according to an embodiment of the present invention. Again, central ground plane 232 may run between top housing portion 268 and bottom portion 269. Central ground plane 232 may terminate in through-hole contact portions 239. Through-hole contact portions 922 for the differential signal contact may be located between through-hole contact portions 912 and 932 for power supply and ground and through-hole contact portions 239 for central ground plane 232.

Again, differential signals conveyed on contacts 920 (shown in FIG. 9) may be at least partially surrounded by power supply contact 910, ground contact 930 (both shown in FIG. 9), and central ground plane 232. Unfortunately, energy may be stored between the differential pair signal on contacts 920 and the power supply contact 910 and ground contact 930. This stored energy may be reflected between printed circuit board 510 (shown in FIG. 22) on which connector receptacle 200 is mounted and connector insert 2230 (shown in FIG. 22) that may be mated with connector receptacle 200. These reflections may create insertion loses that may increase with frequency. An example is shown in the following figure.

Figure 11:
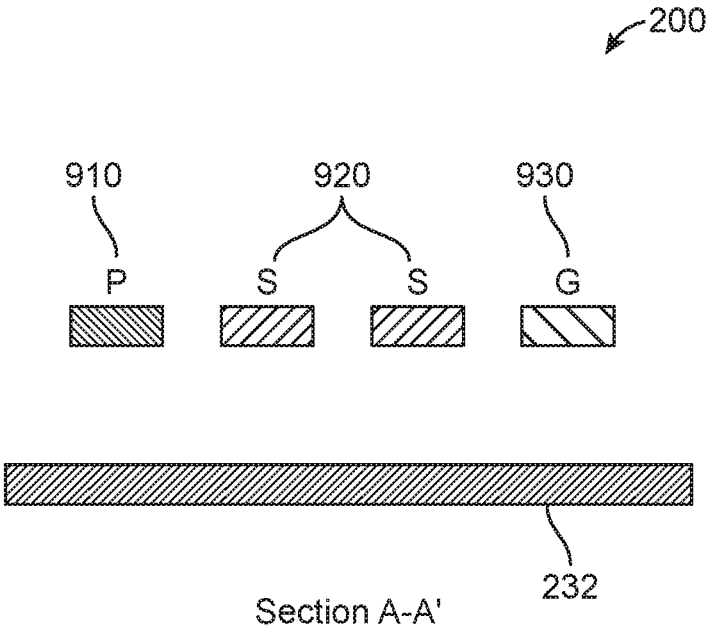
FIG. 11 illustrates a cross-section of a connector receptacle according to an embodiment of the present invention.

FIG. 11 illustrates a simplified cross-section of connector receptacle 200 according to an embodiment of the present invention. This cross-section may be taken along line A-A', as shown in FIG. 10. Again, contacts 920 for a differential signal may be surrounded by power supply contact 910 and ground contact 930, and may be located over central ground plane 232. The energy stored between differential signal contacts 920 and power supply contact 910 or differential signal contacts 920 and ground contact 930 may be reflected between a printed circuit board 510 (shown in FIG. 22) on which connector receptacle 200 is mounted and connector insert 2230 (shown in FIG. 22) that is mated with connector receptacle 200. These reflections may lead to a resonance effect. This stored energy and resulting reflections, or resonance effect, may result in an insertion loss that may increase with frequency. Accordingly, embodiments of the present invention may employ components or circuits to reduce the impedance of power supply contact 910 and ground contact 930. An example is shown in the following figure.

Figure 12:
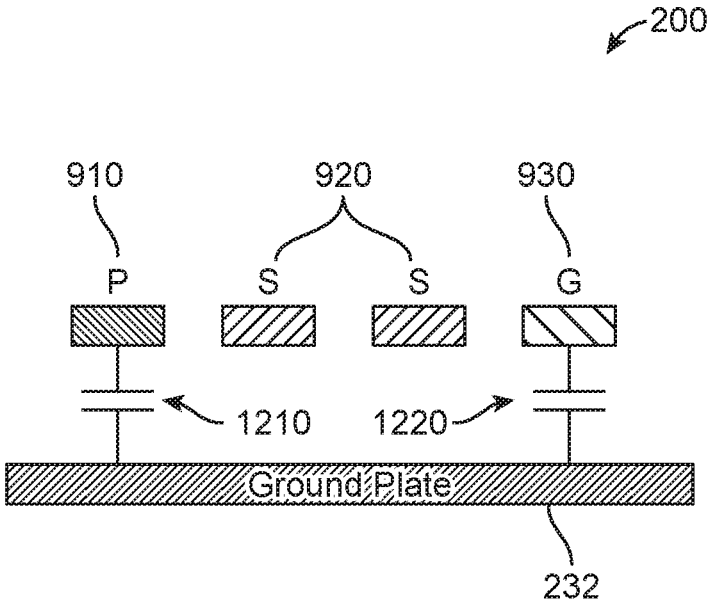
FIG. 12 illustrates a cross-section of a connector receptacle according to an embodiment of the present invention.

FIG. 12 illustrates a cross-section of connector receptacle 200 according to an embodiment of the present invention. In this example, decoupling capacitor 1210 has been connected between power supply contact 910 and central ground plane 232. Similarly, decoupling capacitor 1220 has been connected between ground contact 930 and central ground plane 232. Decoupling capacitors 1210 and 1220 may reduce the energy stored between the differential signal contacts 920 and power supply contact 910 and differential signal contacts 920 and ground contact 930 at high frequency. This may reduce or eliminate the reflections or resonance effect, thereby reducing resulting insertion losses for the differential signal. In various embodiments of the present invention, various types of capacitor structures may be used as decoupling capacitors 1210 and 1220. For example, high-dielectric constant structures may be located between power supply contact 910 and central ground plane 232 and between ground contact 930 and central ground plane 232. In these and other embodiments of the present invention, other types of capacitor structures, such as discrete capacitors, may be used. These decoupling capacitors 1210 and 1220 may be located in a housing of a combined connector receptacle, in a housing of an individual connector receptacle, in a tongue of a connector receptacle, or elsewhere in a combined connector receptacle. Examples are shown in the following figures.

Figure 13:
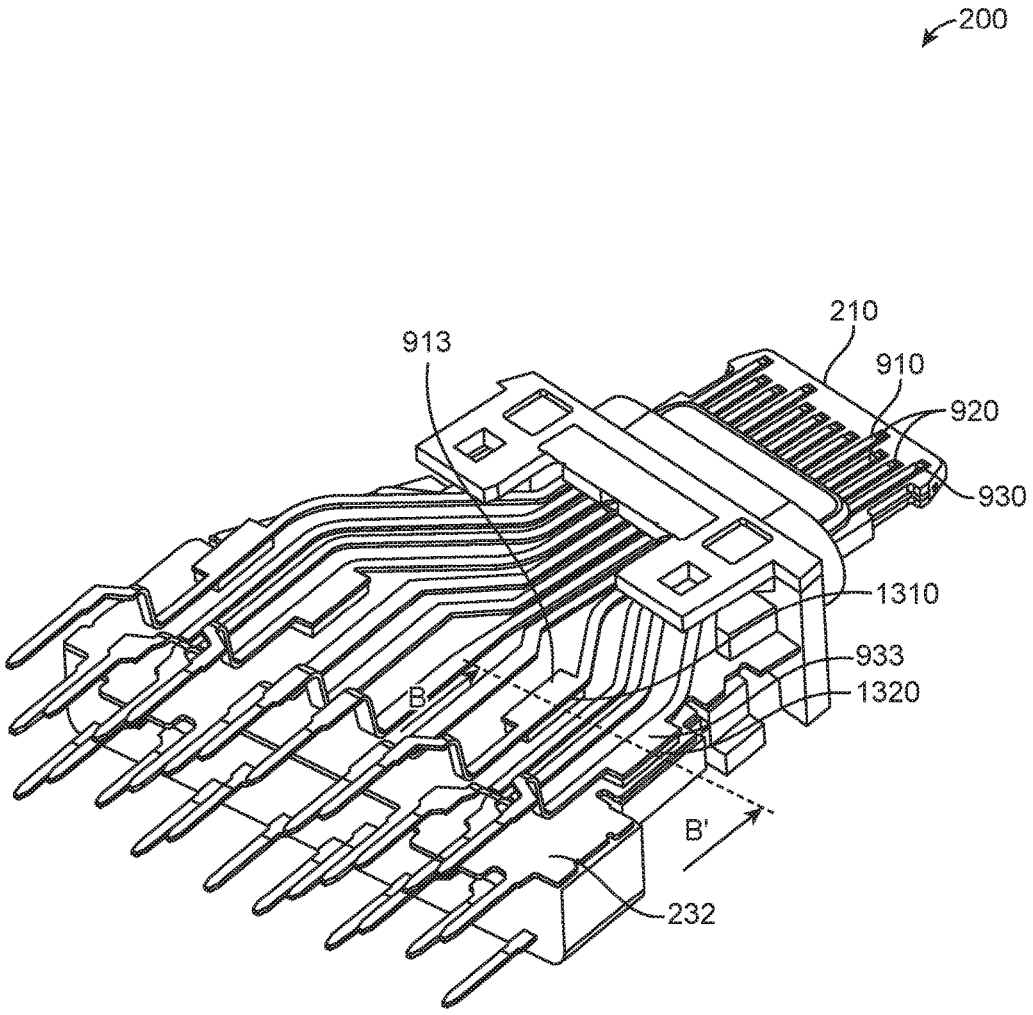
FIG. 13 illustrates a transparent view of a connector receptacle according to an embodiment of the present invention.

FIG. 13 illustrates a transparent view of connector receptacle 200 according to an embodiment of the present invention. In this example, power supply contact 910 may include a widened region 913. High-dielectric constant structure 1310 may be located between widened region 913 and central ground plane 232 to form decoupling capacitor 1210 (shown in FIG. 12). Similarly, ground contact 930 may include widened region 933. High-dielectric constant structure 1320 may be located between widened region 933 and central ground plane 232 to form decoupling capacitor 1220 (shown in FIG. 12). These decoupling capacitors 1210 and 1220 may reduce energy stored between power supply contact 910 and differential signal contacts 920, and between differential signal contacts 920 and ground contact 930. This reduced store energy may reduce or eliminate reflections or resonance effect and the insertion loss for the differential signal on contacts 920.

While high-dielectric constant structure 1310 and high-dielectric constant structure 1320 are shown as being formed in a housing of a connector receptacle, in other embodiments of the present invention, high-dielectric constant structure 1310 and high-dielectric constant structure 1320 may be located elsewhere in a combined connector receptacle or individual connector receptacle, such as in tongue 210. In these and other embodiments of the present invention, tongue 210 may be formed of a printed circuit board. High-dielectric constant structure 1310 and high-dielectric constant structure 1320 may be located in or on layers (not shown) of a printed circuit board forming tongue 210.

Figure 14:
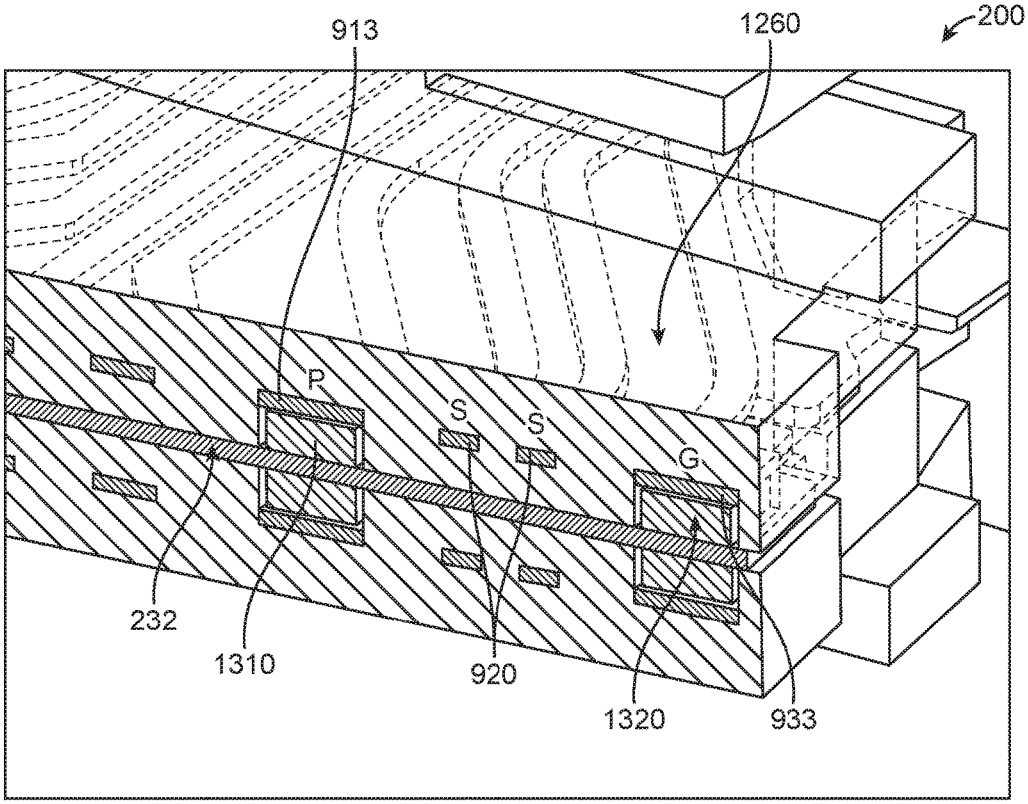
FIG. 14 illustrates a cutaway side view of a connector receptacle according to an embodiment of the present invention.

FIG. 14 illustrates a cutaway side view of connector receptacle 200 according to an embodiment of the present invention. High-dielectric constant structures 1310 and 1320 may be located in housing 1260. High-dielectric constant structure 1310 may be located between central ground plane 232 and widened portion 913 of power supply contact 910 as shown in FIG. 13 to form decoupling capacitor 1210 (shown in FIG. 12). Similarly, high-dielectric constant structure 1320 may be located between central ground plane 232 and widened portion 933 of ground contact 930 as shown in FIG. 13 to form decoupling capacitor 1220 (shown in FIG. 12.) Signal contacts 920 may be located between the widened portion 913 of power supply contact 910 and widened portion 933 of ground contact 930. Signal contacts 920 may convey a differential signal pair.

Again, in other embodiments of the present invention, other capacitor structures may be used as decoupling capacitors 1210 and 1220. For example, discrete capacitors, such as ceramic, film, electrolytic, or other types of capacitors may be used. One or more biasing elements, such as springs, compressible conductive foams, or other materials may be used to electrically connect a capacitor between a power contact and a central ground plane and a ground contact and the central ground plane. An example is shown in the following figure.

Figure 15:
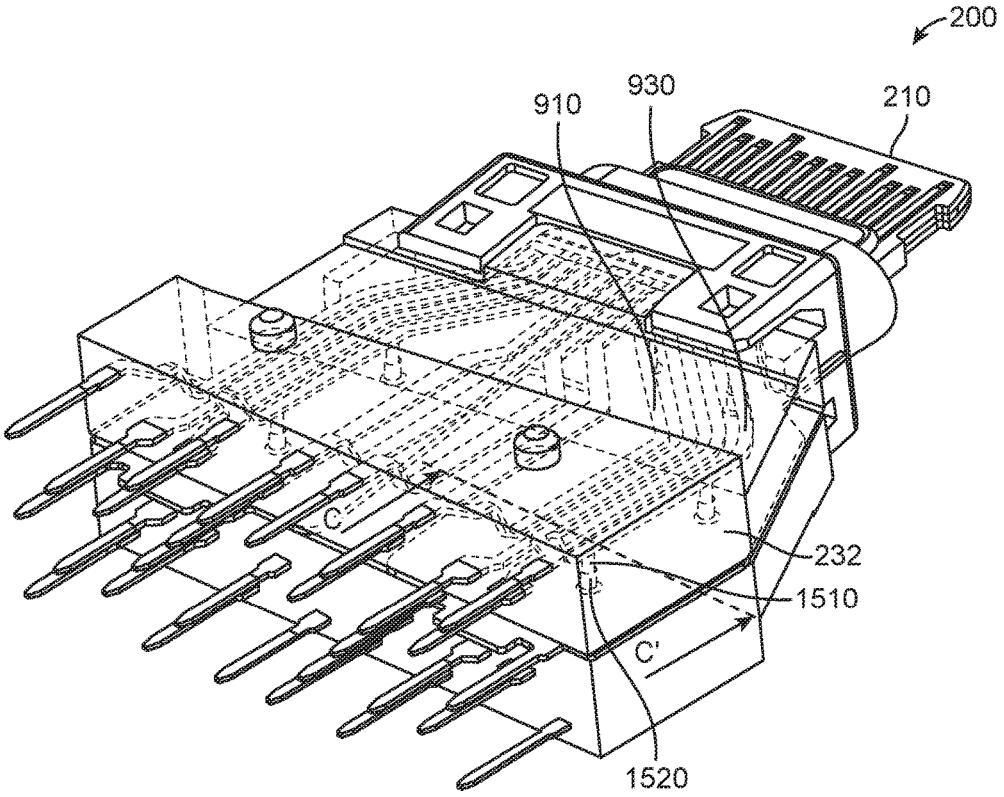
FIG. 15 illustrates a transparent view of a connector receptacle according to an embodiment of the present invention.

FIG. 15 illustrates a transparent view of connector receptacle 200 according to an embodiment of the present invention. In this example, discrete capacitors 1510 (which may be used for capacitors 1210 and 1220 in FIG. 12) and corresponding biasing members 1520 may be placed in series between power supply contact 910 and central ground plane 232 and ground contact 930 and central ground plane 232. Again, the biasing member 1520 may be a spring, compressible conductive foam, or other structure.

While capacitors 1510 and biasing members 1520 are shown as being located in a housing of a connector receptacle, in other embodiments of the present invention, capacitors 1510 and biasing members 1520 may be located elsewhere in a combined connector receptacle or individual connector receptacle, such as in tongue 210. In these and other embodiments of the present invention, tongue 210 may be formed of a printed circuit board. Capacitors 1510 and biasing members 1520 may be located in or on layers (not shown) of a printed circuit board forming tongue 210.

Figure 16:
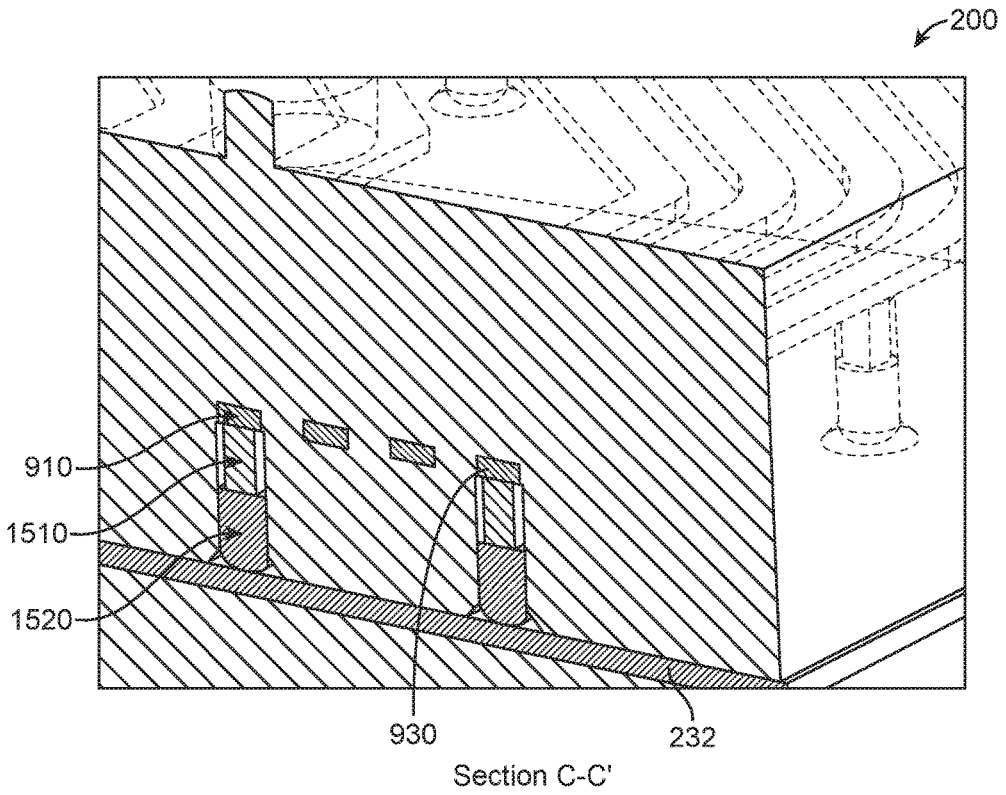
FIG. 16 illustrates a cutaway side view of a connector receptacle according to an embodiment of the present invention.

FIG. 16 illustrates a cutaway side view of connector receptacle 200 according to an embodiment of the present invention. In this example, capacitor 1510 may be adjacent to power supply contact 910. Biasing member 1520 may be located between capacitor 1510 and central ground plane 232. Biasing member 1520 may be formed of a spring, compressible conductive foam, or other structure. The same structure may be replicated for ground contact 930 as shown in FIG. 15. In these and other embodiments of the present invention, the positions of capacitor 1510 and biasing member 1520 may be reversed, though capacitor 1510 and biasing member 1520 may remain in series between power supply contact 910 or ground contact 930 and central ground plane 232.

Figure 17:
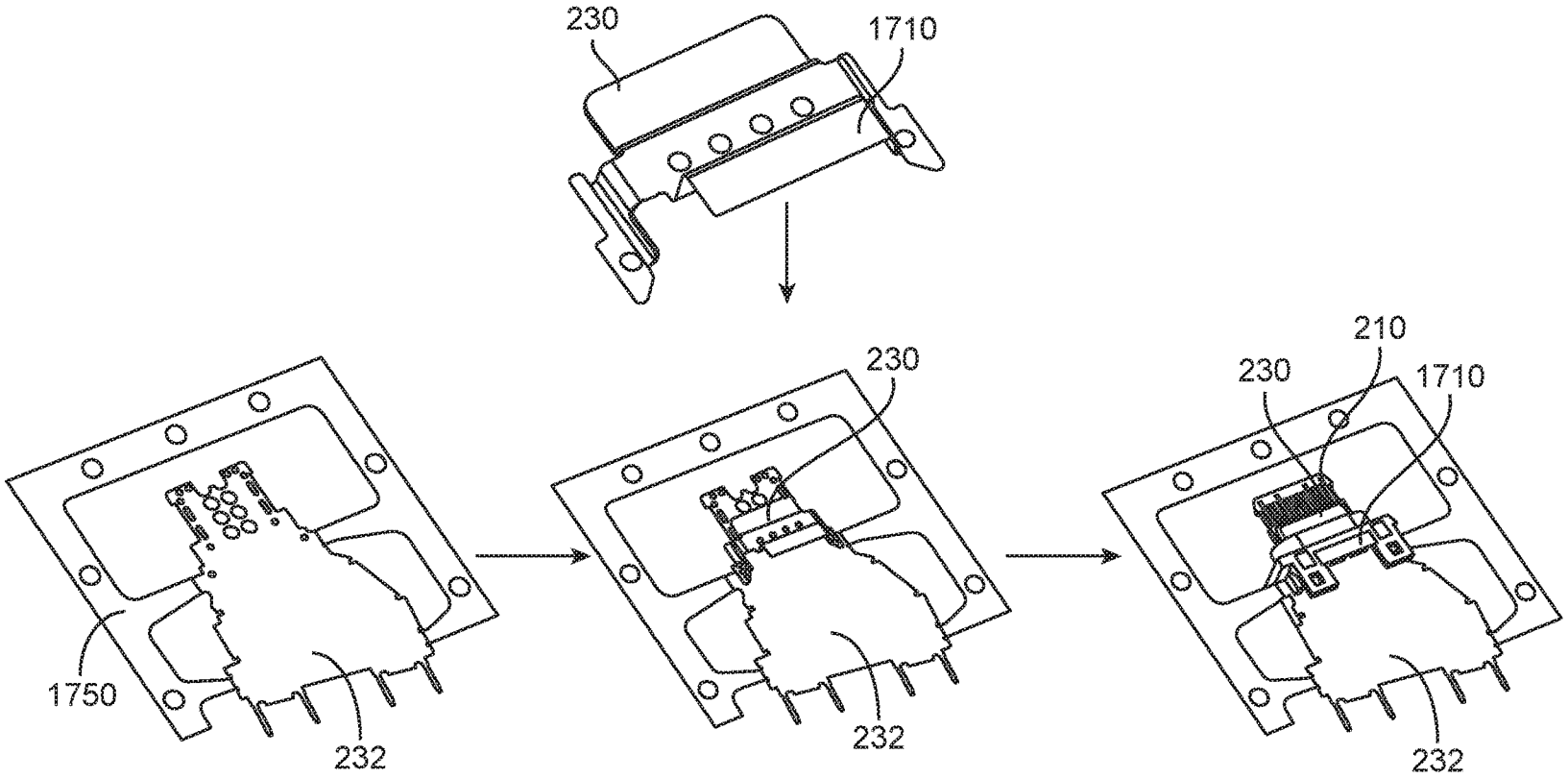
FIGS. 17-21 illustrates a method of assembling a connector receptacle according to an embodiment of the present invention.

FIGS. 17-21 illustrates a method of assembling connector receptacle 200 according to an embodiment of the present invention. In FIG. 17, central ground plane 232 may be formed by stamping, printing, or other process. Carrier 1750 may be attached and may be used to manipulate central ground plane 232 during later processing steps. A ground contact portion including ground contact 230 and ground tab 1710 may be formed, again by stamping or other procedure. The ground contact portion including ground contact 230 may be attached to central ground plane 232. This may be done by spot or laser welding, or other procedure. Tongue 210 may be injection molded or otherwise formed around top portions of central ground plane 232.

Figure 18:
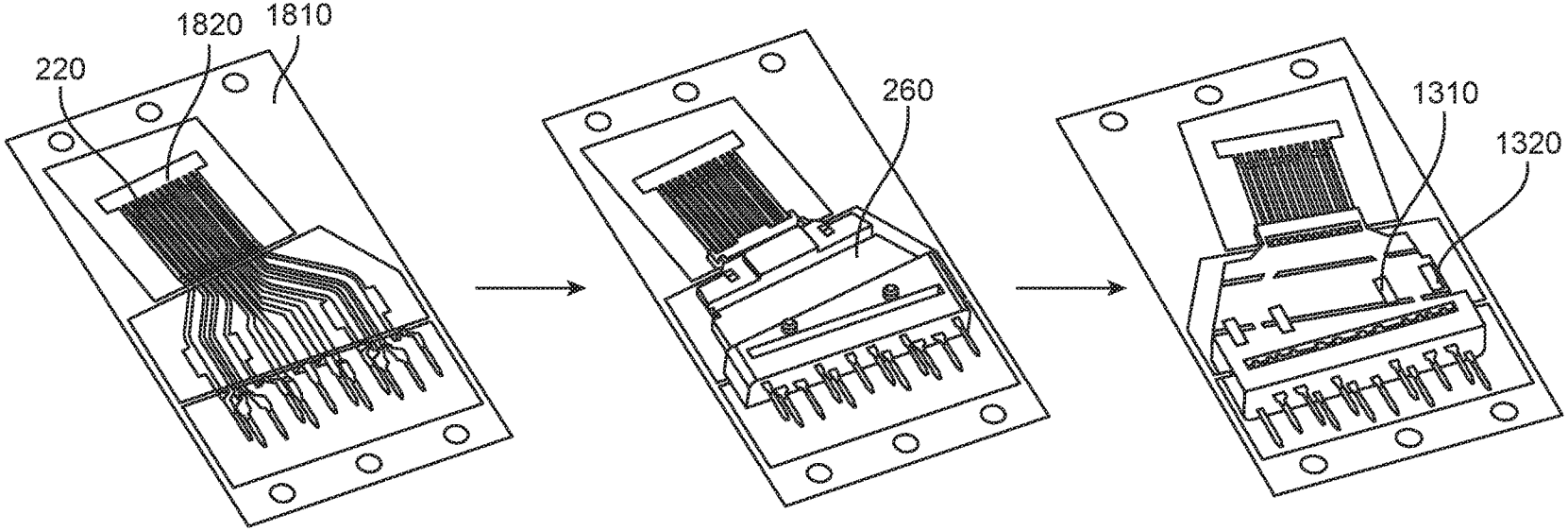

In FIG. 18, contacts 220 may be formed. Carrier 1810 and subcarrier 1820 may be used to manipulate contacts 220 during later processing steps. Housing 260 may be formed around portions of contacts 220. Housing 260 may be formed by injection molding or other processing procedure. High-dielectric constant structures 1310 and 1320 may be attached to contacts 220 after housing 260 is injection molded.

Figure 19:
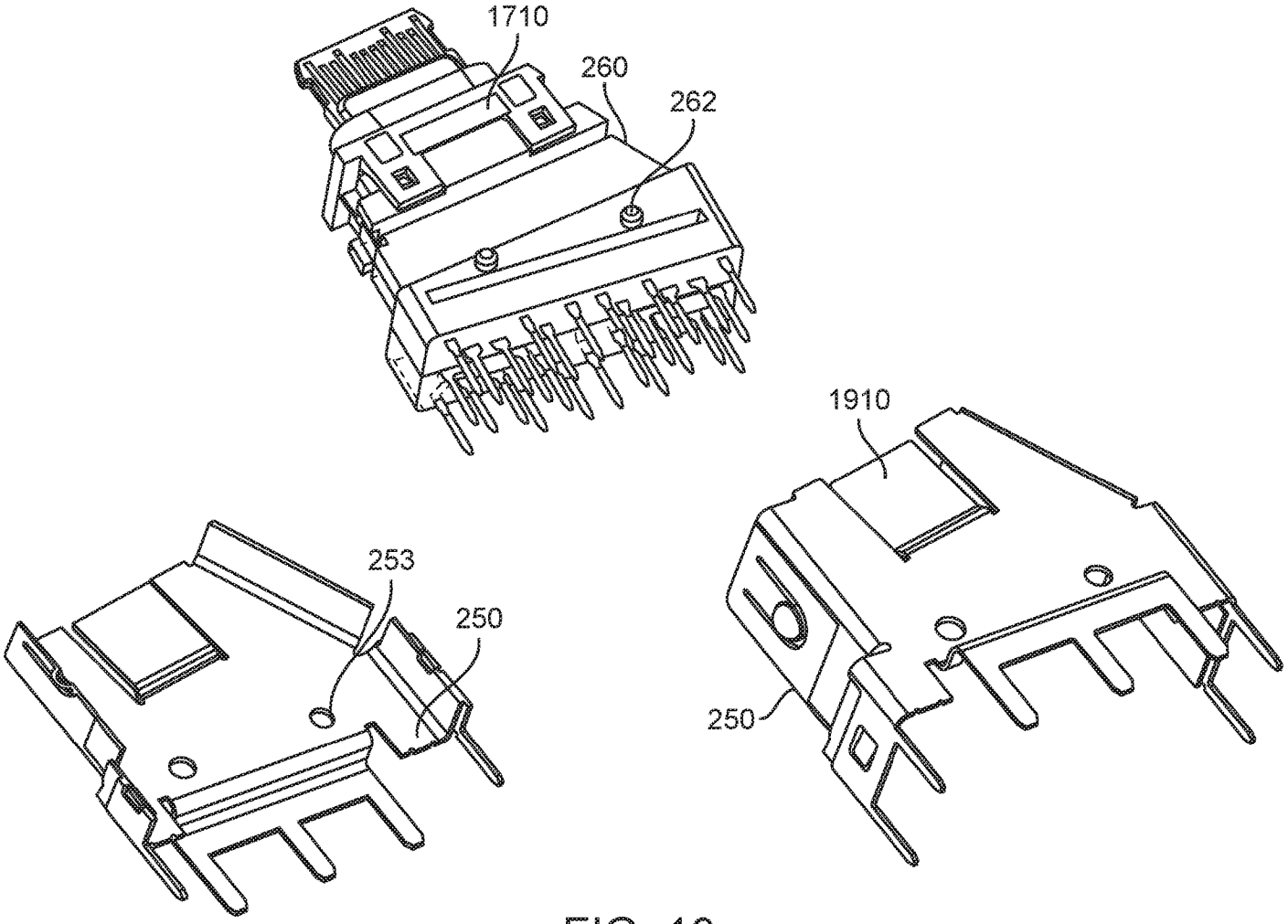

In FIG. 19, shield 250 may be placed around housing 260. Dimples 262 may emerge through openings 253 in shield 250.

Figure 20:
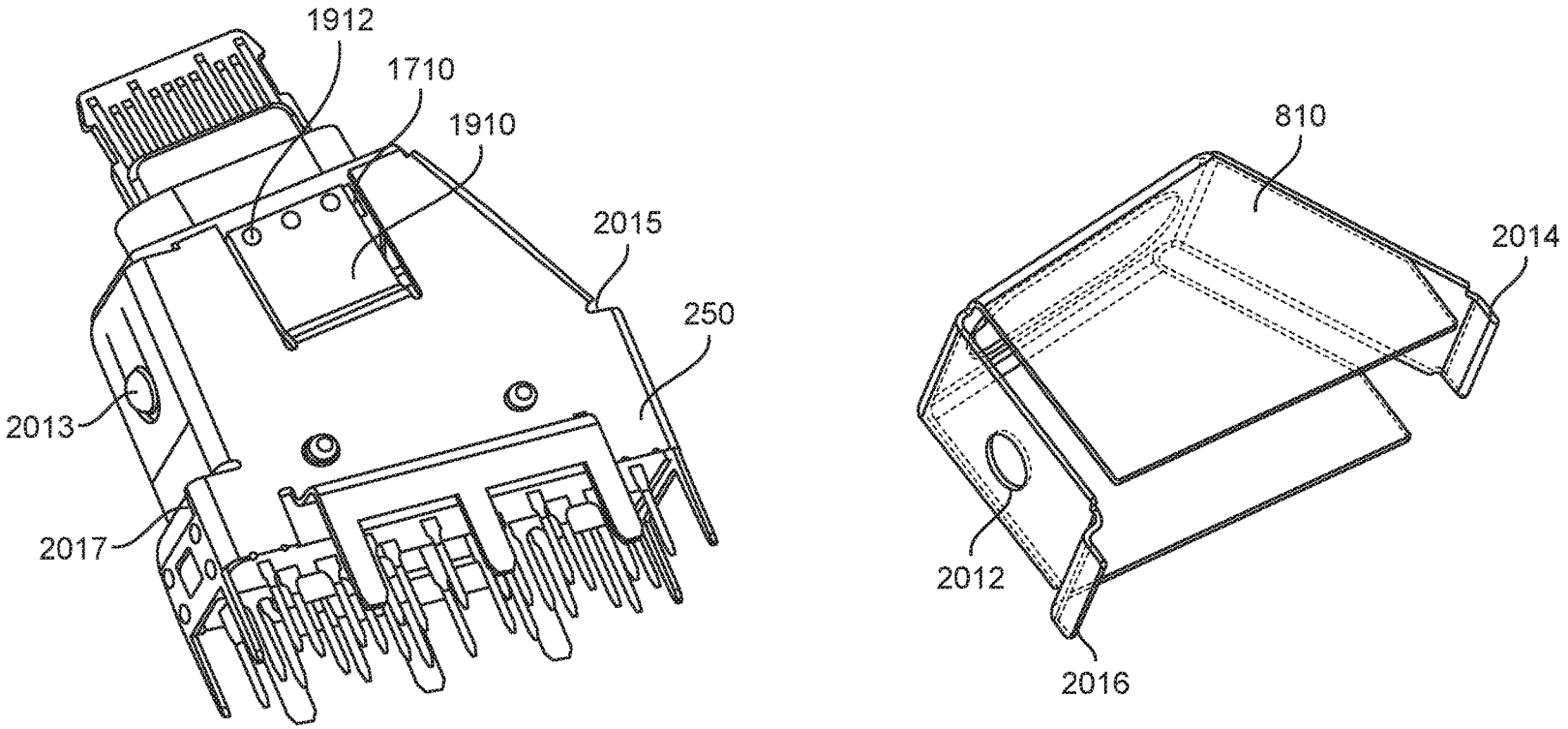

In FIG. 20, an over-shield portion 810 may be fit over shield 250. Tabs 2014 and 2016 may be inserted into openings 2015 and 2017 in shield 250. Dimple 2013, located on shield 250, may fit in opening 2012 in over-shield portion 810, thereby securing over-shield portion 810 in place. Shield portion 1910 of shield 250 may be spot or laser welded at points 1912 to ground tab 1710.

Figure 21:
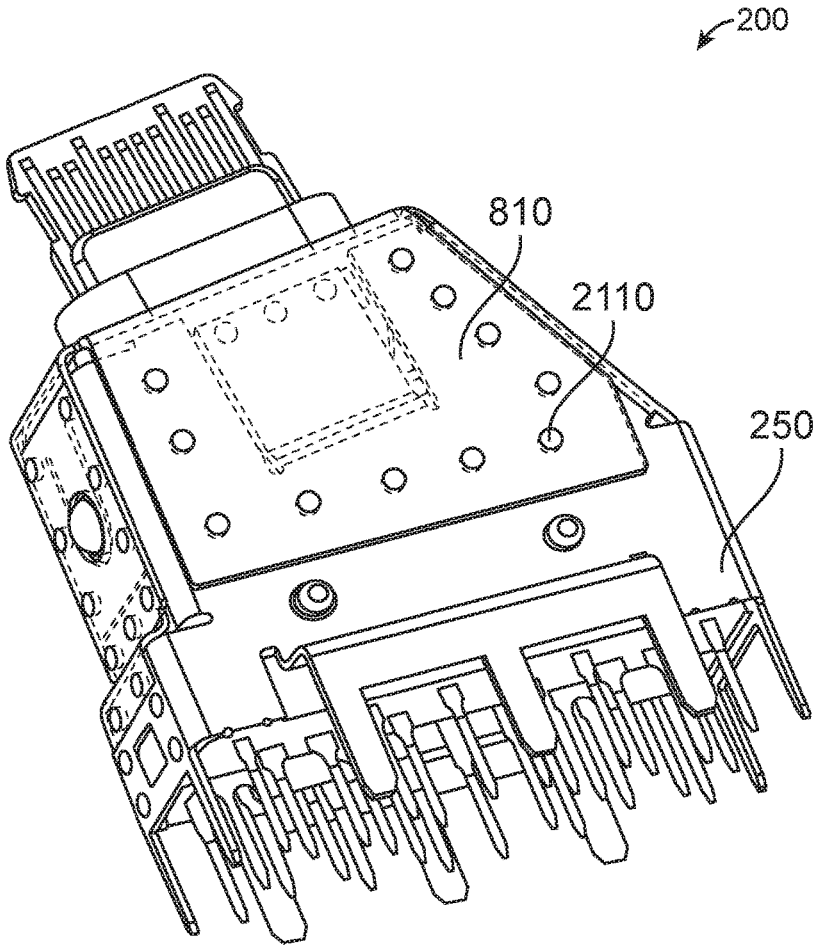

In FIG. 21, over-shield portion 810 may be spot or laser welded at points 2110 to shield 250, thereby resulting in a completed connector receptacle 200.

Figure 23:
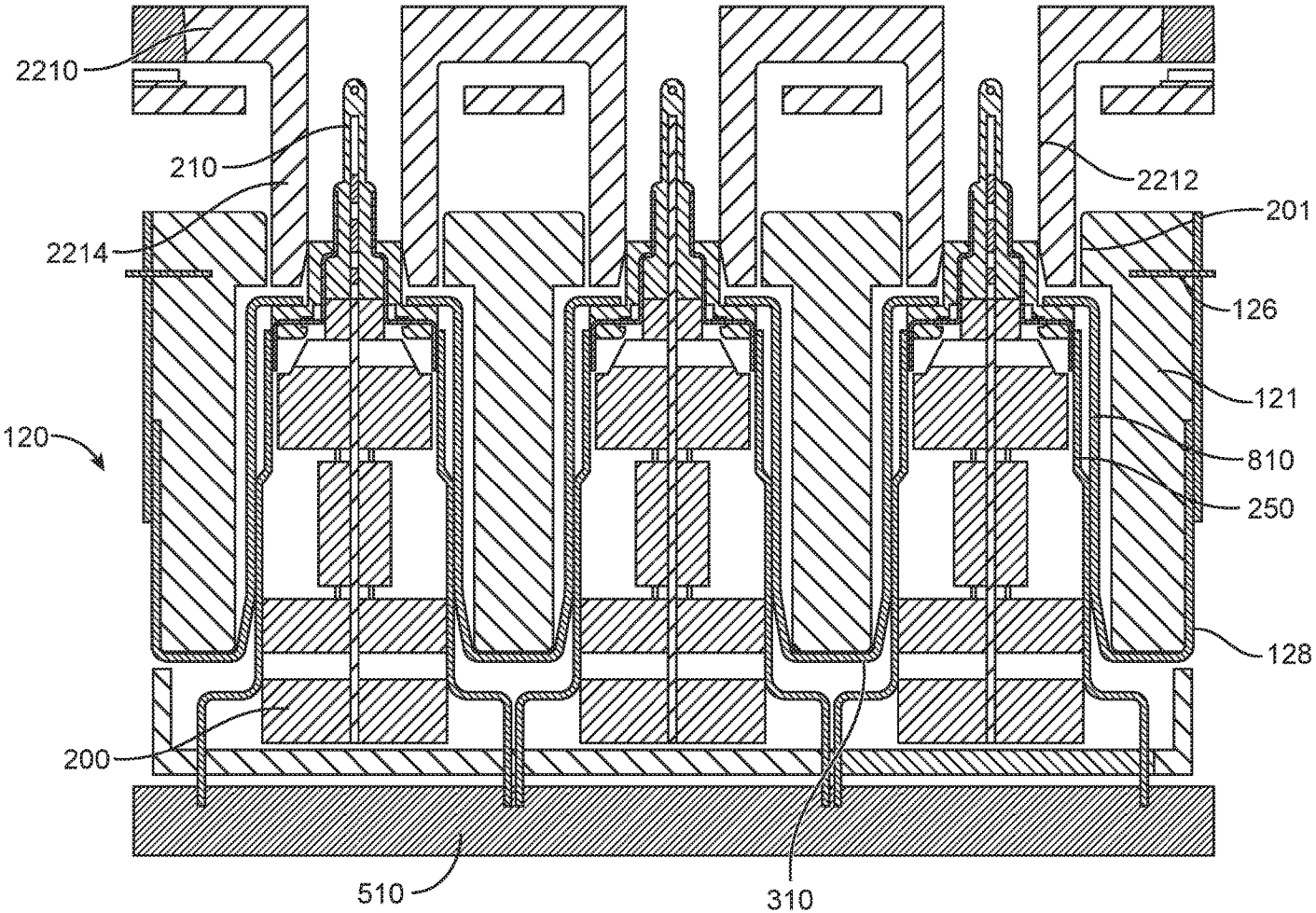

FIGS. 22-23 are side views of combined connector receptacle 120 in an electronic device according to an embodiment of the present invention. In FIG. 22, the electronic device may include a device enclosure 2210. Device enclosure 2210 may include openings 2212, which may provide access to tongues 210 of connector receptacles 200 by connector inserts 2230. Openings 2212 in device enclosure 2210 may be defined by sidewalls 2214. Sidewalls 2214 may be inserted into openings 201 in combined connector receptacle housing 121. Combined connector receptacle 120 may be attached to printed circuit board 510. Printed circuit board 510 may again be a printed circuit board, flexible circuit board, or other appropriate substrate.

In FIG. 23, the electronic device may include a device enclosure 2210. Device enclosure 2210 may include openings 2212, which may provide access to tongues 210 of connector receptacles 200. Openings 2212 in device enclosure 2210 may be defined by sidewalls 2214. Sidewalls 2214 may be inserted into openings 201 in combined connector receptacle housing 121. Combined connector receptacle 120 may be attached to printed circuit board 510.

Connector receptacles 200 may be shielded by shield 250. Over-shield portion 810 may partially cover shield 250. EMI contact rails 310 may connect shields 250 to each other. EMI contact rail 128 may connect shields 250 for outside connector receptacles 200 to shield 126.

Figure 24:
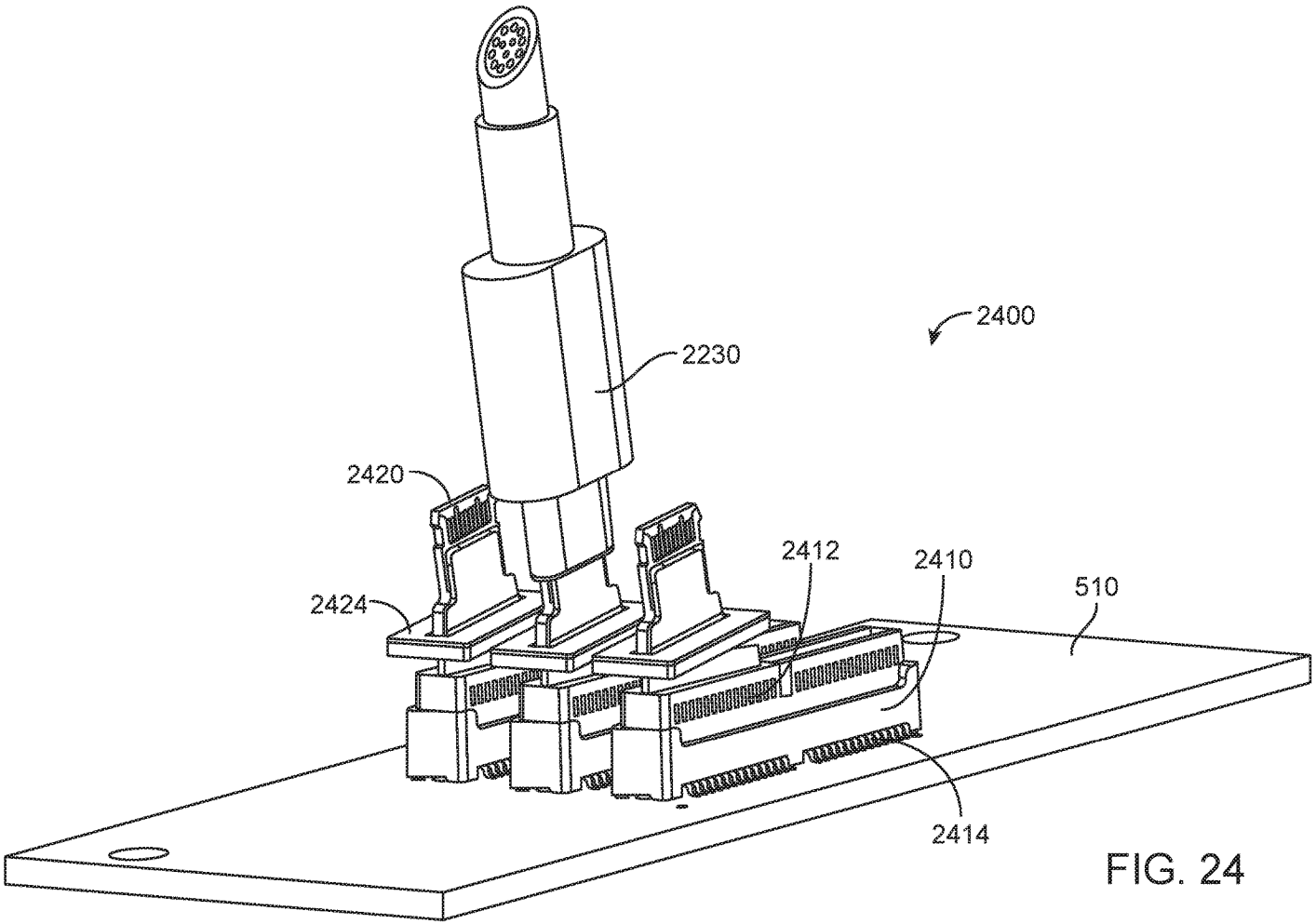
FIG. 24 illustrates another combined connector receptacle according to an embodiment of the present invention.

FIG. 24 illustrates another combined connector receptacle 2400 according to an embodiment of the present invention. Combined connector receptacle 2440 may include card edge connectors 2410. Card edge connectors 2410 may include contacts (not shown) in slots 2412 that terminate in surface-mount portions 2414. Surface mount portions 2414 may be soldered or otherwise connected to traces (not shown) on printed circuit board 510. Tongues 2420 may be formed of printed circuit boards, they may be injection molded, or they may be formed in other ways. Tongue 2220 may be the same as, substantially the same as, or similar to, tongue 210 of FIG. 2. Tongue 2220 may have the same or similar features as tongue 210, such as contacts 220, contacting portions 221, ground contacts 230, notches 240, side ground contacts 233, and central ground plane 232 as shown in FIG. 2, as well as optional capacitors 1210 and 1220 as shown in FIG. 12. Bracket 2424 may be placed around tongue 2420. Tongues 2420 may be accessed by connector insert 2230.

Figure 25:
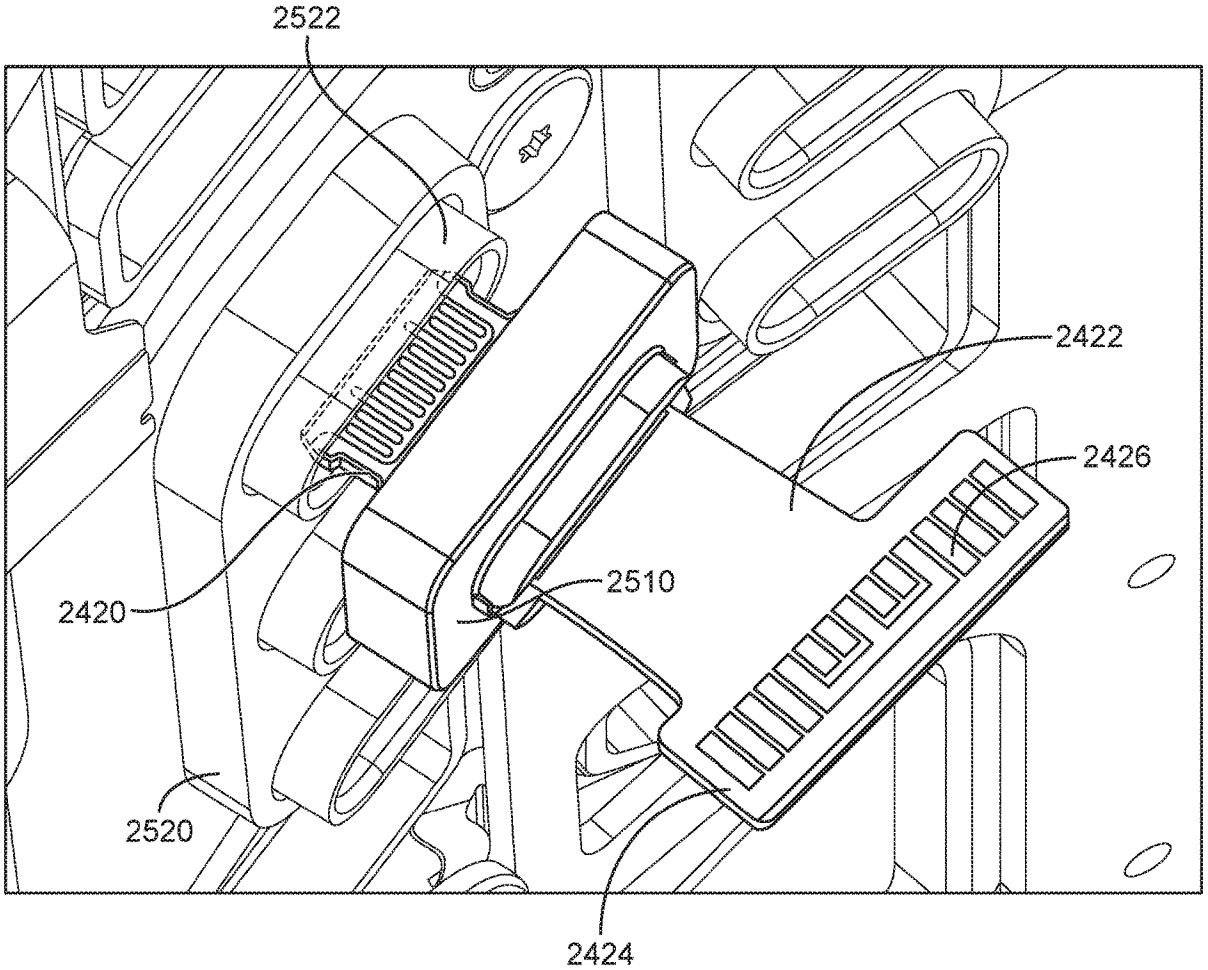
FIG. 25 illustrates a tongue for a combined connector receptacle and a corresponding device enclosure according to an embodiment of the present invention.

FIG. 25 illustrates a tongue 2420 for a combined connector receptacle and a corresponding device enclosure 2520 according to an embodiment of the present invention. Tongue 2420 may include a rear portion 2422 leading to a wide portion 2424. Wide portion 2424 may support contacts 2426 on its top and bottom sides. Contacts 2426 may connect to contacts (not shown) of card edge connectors 2410 in FIG. 24. Receptacle housing 2510 may be located around tongue 2420. Receptacle housing 2510 may fit around raised guide 2522 of device enclosure 2520.

Figure 26:
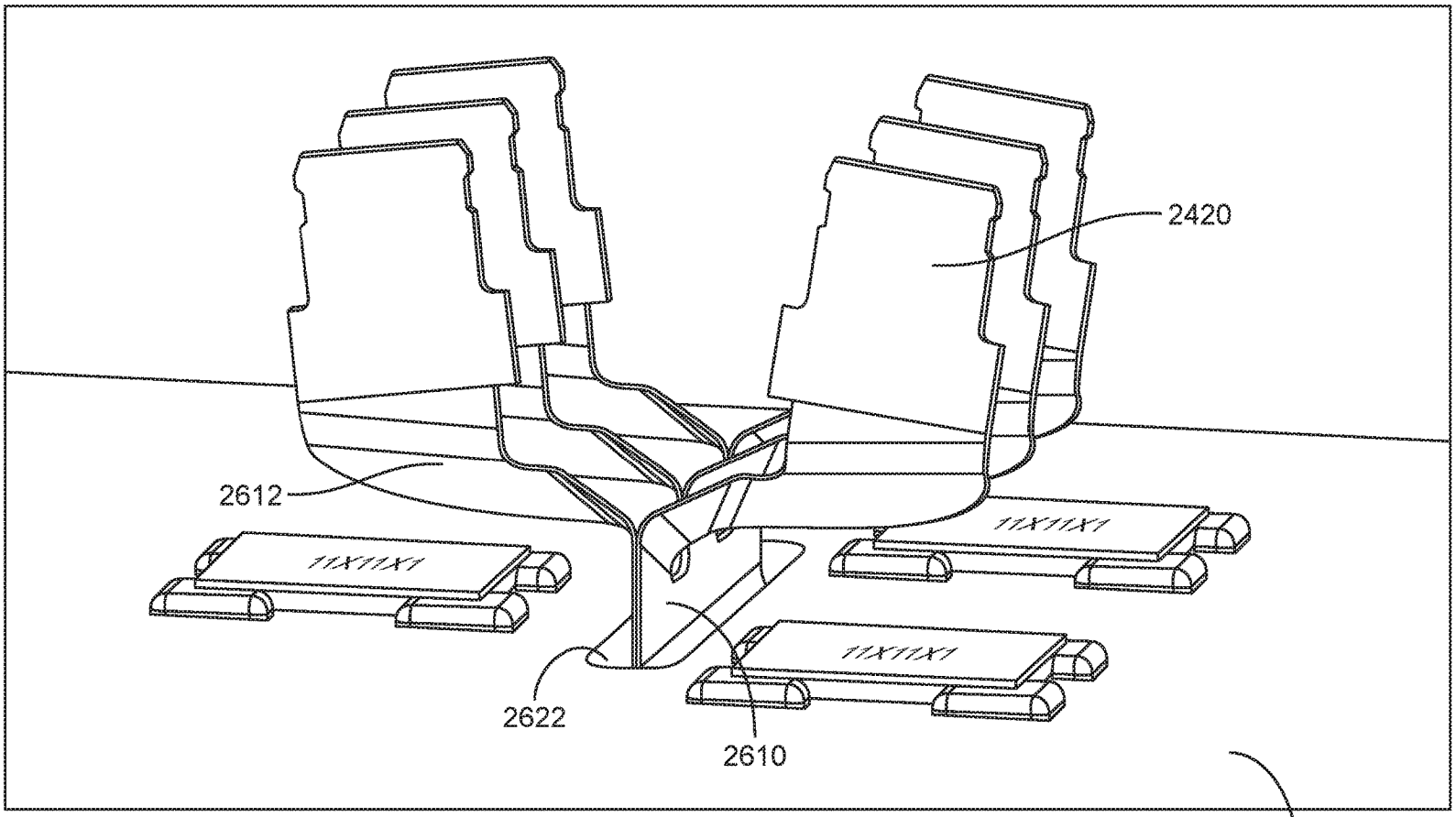
FIG. 26 illustrates a portion of another combined connector receptacle according to an embodiment of the present invention.

FIG. 26 illustrates a portion of another combined connector receptacle according to an embodiment of the present invention. In this example, tongues 2420 may be connected to flexible circuit board portions 2612, which may each be split from main flexible circuit board 2610. Main flexible circuit board 2610 may pass through opening 2622 in printed circuit board 2620. Printed circuit board 2620 may be a printed circuit board, flexible circuit board, or other appropriate substrate.

In various embodiments of the present invention, contacts, central ground planes, shields, EMI contact rails, and other conductive portions of a combined connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings, tongues, organizers, and other portions may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The biasing members and high-dielectric constant structures may be formed of various materials. The printed circuit boards used may be formed of FR-4 or other material. Printed circuit boards may be replaced by other substrates, such as flexible circuit boards, in many embodiments of the present invention.

Embodiments of the present invention may provide combined connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These combined connector receptacles may provide pathways for signals that are compliant with various standards such as one of the Universal Serial Bus (USB) standards including USB Type-C, High-Definition Multimedia Interface (HDMI), Digital Visual Interface (DVI), Ethernet, DisplayPort, Thunderbolt, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these connector inserts and connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A combined connector receptacle comprising:

a combined connector receptacle housing having a plurality of slots;

a plurality of EMI contact rails in the plurality of slots in the combined connector receptacle housing;

a first shield around sides of the combined connector receptacle; and a plurality of connector receptacles, each inserted in a corresponding slot;

each of the plurality of connector receptacles comprising:

a tongue supporting contacting portions for each of a plurality of contacts;

a connector receptacle housing supporting the plurality of contacts;

a central ground plane, the central ground plane forming a ground plane in the center of the tongue and side ground contacts on sides of the tongue; and a connector receptacle shield around at least a side of the connector receptacle housing, wherein the connector receptacle shield for each of the connector receptacles are electrically connected to the first shield via the EMI contact rails.

2. The combined connector receptacle of claim 1, wherein the connector receptacle housing for each connector receptacle comprises a top connector receptacle housing and a bottom connector receptacle housing, one on each side of the central ground plane.

3. The combined connector receptacle of claim 1, wherein the connector receptacle shield for each of the plurality of connector receptacles comprises a tab.

4. The combined connector receptacle of claim 1, further comprising an alignment pin emerging from a front of the combined connector receptacle housing.

5. The combined connector receptacle of claim 1, further comprising an organizer located at a bottom side of the combined connector receptacle housing, the organizer having a passage for through-hole contact portions of each of the plurality of contacts in each of the plurality of connector receptacles.

6. The combined connector receptacle of claim 1, wherein the tongue for each of the plurality of connector receptacles further comprises a top ground contact and a bottom ground contact such that the contacting portions for each of the plurality of contacts are between the top and bottom ground contacts and a leading edge of the tongue.

7. The combined connector receptacle of claim 1, wherein each tongue of the combined connector receptacle is located in an opening in a portion of device enclosure, the portion of the device enclosure separate from the combined connector receptacle, the openings in the portion of the device enclosure and the connector receptacles forming a complete connector receptacle including a connector receptacle recess and a tongue, wherein spacing among the tongues is set by the locations of the openings in the portion of the device enclosure.

8. The combined connector receptacle of claim 7, wherein the portion of the device enclosure is metallic.

9. The combined connector receptacle of claim 7, wherein the portion of the device enclosure further comprises a plurality of ground fingers to electrically connect to the connector receptacle shield on each connector receptacle.

10. The combined connector receptacle of claim 1, wherein each connector receptacle further comprises:

a first contact in the plurality of contacts; and a first capacitor structure located in the connector receptacle housing and coupled between the first contact and the central ground plane.

11. The combined connector receptacle of claim 10, wherein each connector receptacle further comprises:

a second contact in the plurality of contacts;

a second capacitor structure located in the connector receptacle housing and coupled between the second contact and the central ground plane;

a third contact between the first contact and the second contact; and a fourth contact between the first contact and the second contact.

12. The combined connector receptacle of claim 10, wherein the first capacitor structure is a first high-dielectric constant structure.

13. The combined connector receptacle of claim 10, wherein the first capacitor structure is a first decoupling capacitor.

14. A combined connector receptacle comprising a plurality of connector receptacles, each connector receptacle comprising:

a tongue;

a central ground plane, the central ground plane forming a ground plane in the center of the tongue and side ground contacts on sides of the tongue;

a first housing on a first side of the central ground plane;

a second housing on a second side of the central ground plane;

a first contact passing from the tongue through the first housing; and a first capacitor structure coupled between the first contact and the central ground plane, the combined connector receptacle further comprising a combined connector receptacle housing having a plurality of slots, each of the connector receptacles located in a corresponding one of the plurality of slots.

15. The combined connector receptacle of claim 14, wherein each connector receptacle further comprises:

a second contact passing through the first housing;

a second capacitor structure coupled between the second contact and the central ground plane; and a third contact between the first contact and the second contact.

16. The combined connector receptacle of claim 15, wherein each connector receptacle further comprises:

a fourth contact between the first contact and the second contact, wherein the first contact conveys a power supply, the second contact conveys a ground, and the third and fourth contacts convey a differential signal.

17. The combined connector receptacle of claim 15, wherein the first capacitor structure is a first high-dielectric constant structure and the second capacitor structure is a second high-dielectric constant structure.

18. The combined connector receptacle of claim 15, wherein the first capacitor structure is a first decoupling capacitor and the second capacitor structure is a second decoupling capacitor, and wherein each connector receptacle further comprises:

a first biasing member in series with the first decoupling capacitor and between the first contact and the central ground plane; and a second biasing member in series with the second decoupling capacitor and between the second contact and the central ground plane.

19. The combined connector receptacle of claim 18, wherein the first biasing member is one of a spring or compressible conductive foam.

20. The combined connector receptacle of claim 15, wherein the first, second, and third contacts for each connector receptacle terminate in through-hole contact portions, and further comprising:

an organizer having openings for the through-hole contact portions.

21. The combined connector receptacle of claim 14, wherein the first capacitor structure is located in the tongue.

22. A combined connector receptacle comprising:

a combined connector receptacle housing having a plurality of slots; and a plurality of connector receptacles, each inserted in a corresponding slot in the a combined connector receptacle housing;

each of the plurality of connector receptacles comprising:

a tongue supporting a plurality of contacts;

a central ground plane, the central ground plane forming a ground plane in the center of the tongue and side ground contacts on sides of the tongue;

a first housing on a first side of the central ground plane;

a second housing on a second side of the central ground plane;

a first contact passing through the first housing; and a first high-dielectric constant structure coupled between the first contact and the central ground plane.

23. The combined connector receptacle of claim 22, wherein each connector receptacle further comprises:

a second contact passing through the first housing;

a second high-dielectric constant structure coupled between the second contact and the central ground plane; and a third contact between the first contact and the second contact.

24. The combined connector receptacle of claim 23, wherein each connector receptacle further comprises:

a fourth contact between the first contact and the second contact, wherein the first contact conveys a power supply, the second contact conveys a ground, and the third and fourth contacts convey a differential signal.

25. The combined connector receptacle of claim 24, wherein the first high-dielectric constant structure forms a first decoupling capacitor and the second high-dielectric constant structure forms a second decoupling capacitor.

26. The combined connector receptacle of claim 24, wherein the first, second, and third contacts for each connector receptacle terminate in through-hole contact portions, and further comprising:

an organizer having openings for the through-hole contact portions.

* * * * *